US012808019B2

(12) United States Patent
Jensen et al.

(10) Patent No.: US 12,808,019 B2
(45) Date of Patent: Nov. 24, 2026

(54) NICKEL-RUTHENIUM-BASED TERNARY OR GREATER ALLOYS, PRODUCTS COMPRISING THE SAME, AND METHODS OF MAKING AND USING THE SAME

(71) Applicant: Deringer-Ney Inc., Bloomfield, CT (US)

(72) Inventors: Wade A. Jensen, West Hartford, CT (US); Patrick K. Bowen, Windsor, CT (US)

(73) Assignee: Deringer-Ney Inc., Bloomfield, CT (US)

( * ) Notice: Subject to any disclaimer, the term of this patent is extended or adjusted under 35 U.S.C. 154(b) by 468 days.

(21) Appl. No.: 18/375,740

(22) Filed: Oct. 2, 2023

(65) Prior Publication Data

US 2024/0124958 A1 Apr. 18, 2024

Related U.S. Application Data

(60) Provisional application No. 63/472,001, filed on Jun. 9, 2023, provisional application No. 63/415,348, filed on Oct. 12, 2022.

(51) Int. Cl.
*C22F 1/10* (2006.01)
*C22C 19/05* (2006.01)

(52) U.S. Cl.
CPC ..... *C22C 19/058* (2013.01); *C22F 1/10* (2013.01)

(58) Field of Classification Search
CPC ..... C22C 19/058; C22C 19/05; C22C 30/00; C22C 30/02; C22C 19/03; C22C 19/051; C22F 1/10; G01R 1/06755
See application file for complete search history.

(56) References Cited

U.S. PATENT DOCUMENTS 2,105,312 A 1/1938 Sidney
2017/0184534 A1* 6/2017 Goodwin ..... C22C 19/007
2020/0095653 A1 3/2020 Bowen et al.

FOREIGN PATENT DOCUMENTS

JP H0474884 A * 3/1992
WO WO-2020009095 A1 * 1/2020 ..... C22C 19/07

OTHER PUBLICATIONS

Total Materia, Heat Treating of Nickel and Nickel Alloys, https://www.totalmateria.com/en-us/articles/heat-treating-of-nickel-and-nickel-alloys, Dec. 2001 (Year: 2001).*

(Continued)

*Primary Examiner* — Rebecca Janssen
(74) *Attorney, Agent, or Firm* — Dorsey & Whitney LLP

(57) ABSTRACT

Nickel-ruthenium-based ternary or greater alloys, products, and methods of making and using the same include nickel at about 48 to about 71 weight % ("wt %") of the alloy, ruthenium at about 17 to about 45 wt % of the alloy, and at least one ternary or higher addition at greater than zero to about 20 wt % of the Ni—Ru alloy. The ternary or higher addition may include gold, cobalt, chromium, copper, iridium, molybdenum, niobium, palladium, platinum, rhenium, rhodium, tantalum, vanadium, tungsten, or any combination thereof. The Ni—Ru alloy may be age-hardenable, and may exhibit a hardness greater than 500 hardness Knoop. In an embodiment, the Ni—Ru ternary or higher alloy may be used in electronic test probe applications.

18 Claims, 15 Drawing Sheets

(56) References Cited

OTHER PUBLICATIONS

Semiatin et al., Analysis of the homogenization of a nickel-base superalloy, Scripta Materialia 51 (2004) 491-495 (Year: 2004).*
Excel conversion of Table 1 No 4 (Year: 2026).*
Excel conversion Goodwin 1 (Year: 2026).*
Excel conversion Goodwin 2 (Year: 2026).*
Zhu et al., Experimental determination of the Ni—Cr—Ru phase diagram and thermodynamic reassessments of the Cr—Ru and Ni—Cr—Ru systems, Intermetallics 64 (2015) pp. 86-95. (Year: 2015).*
International Search Report and Written Opinion dated Dec. 21, 2023 in connection with International Patent Application No. PCT/US2023/034283, 13 pages.
Glaner L., A study of the Ni—Pt—Ru and Co—Pt—Ru systems, University of the Witzetersrand (2009).
Paliney 25, General Alloy Overview, https://deringerney.com/.
Paliney 7, General Alloy Overview, http://deringerney.com/.
Paliney H3C, General Alloy Overview, https://deringerney.com.

* cited by examiner

Table 1

| Alloy | Composition (wt.%) | | | | | | | | | | | | | | | | | | |
|---|---|---|---|---|---|---|---|---|---|---|---|---|---|---|---|---|---|---|---|
| | Ni | Ru | Pt | Re | W | Co | Mo | Pd | Rh | Ta | Nb | Au | Ir | Cr | V | Zr | Cu | Ti | Fe |
| 2147 | 71.2 | 28.8 | | | | | | | | | | | | | | | | | |
| 2148 | 59.9 | 40.1 | | | | | | | | | | | | | | | | | |
| 2179 | 65.4 | 34.6 | | | | | | | | | | | | | | | | | |
| 2180 | 56.7 | 38.0 | 5.3 | | | | | | | | | | | | | | | | |
| 2181 | 53.7 | 36.0 | 10.3 | | | | | | | | | | | | | | | | |
| 2182 | 50.9 | 34.1 | 15.0 | | | | | | | | | | | | | | | | |
| 2183 | 54.0 | 36.1 | | 9.9 | | | | | | | | | | | | | | | |
| 2184 | 55.3 | 27.7 | | 17.0 | | | | | | | | | | | | | | | |
| 2185 | 51.2 | 17.2 | | 31.6 | | | | | | | | | | | | | | | |
| 2186 | 54.0 | 36.2 | | | 9.8 | | | | | | | | | | | | | | |
| 2187 | 57.8 | 38.8 | | | | 3.4 | | | | | | | | | | | | | |
| 2188 | 56.6 | 38.0 | | | | | 5.4 | | | | | | | | | | | | |
| 2189 | 56.4 | 37.7 | | | | | | 5.9 | | | | | | | | | | | |
| 2190 | 56.5 | 37.8 | | | | | | | 5.7 | | | | | | | | | | |
| 2191 | 54.1 | 36.2 | | | | | | | | 9.7 | | | | | | | | | |
| 2192 | 56.8 | 38.0 | | | | | | | | | 5.2 | | | | | | | | |
| 2216 | 56.0 | 38.6 | | | | | | | | | | 5.4 | | | | | | | |
| 2217 | 61.0 | 26.2 | | 12.8 | | | | | | | | | | | | | | | |
| 2218 | 52.2 | 35.0 | | | | 12.8 | | | | | | | | | | | | | |
| 2219 | 52.9 | 37.0 | | | | | | | | | | | 10.1 | | | | | | |
| 2220 | 48.1 | 40.7 | | | | | | | | | | | | 11.2 | | | | | |
| 2221 | 55.4 | 37.2 | | | | | | | | | | | | | 7.4 | | | | |
| 2222 | 50.9 | 40.1 | | | | | | | | | | | | | | 9.0 | | | |
| 2223 | 54.3 | 39.9 | | | | | | | | | | | | | | | 5.8 | | |
| 2224 | 55.7 | 37.3 | | | | | | | | | | | | | | | | 7.0 | |
| 2225 | 58.8 | 40.1 | | | | | | | | | 1.1 | | | | | | | | |
| 2226 | 47.9 | 39.2 | | | | | | | | | | | | | | | | | 12.9 |
| 2236 | 59.5 | 39.1 | | | | | | | | | | 1.4 | | | | | | | |
| 2246 | 63.3 | 33.9 | | | | | | | | | | 2.8 | | | | | | | |

FIG. 6A

Table 1 (cont.)

| Alloy | Composition (wt.%) | | | | | | | | | | | | | | | | | | |
|---|---|---|---|---|---|---|---|---|---|---|---|---|---|---|---|---|---|---|---|
| | Ni | Ru | Pt | Re | W | Co | Mo | Pd | Rh | Ta | Nb | Au | Ir | Cr | V | Zr | Cu | Ti | Fe |
| 2247 | 61.2 | | | | | | | | | | | 5.5 | | | | | | | |
| 2248 | 57.4 | 32.0 | | | | | | | | | | 10.6 | | | | | | | |
| 2249 | 59.1 | 38.1 | | | | | | | | | | 2.8 | | | | | | | |
| 2250 | 60.6 | 35.0 | | | | | | | | | | 4.4 | | | | | | | |
| 2251 | 62.0 | 35.8 | | | | | | | | | | 2.2 | | | | | | | |
| 2252 | 59.7 | 39.6 | | | | | | | | | | 0.7 | | | | | | | |
| 2253 | 58.8 | 38.4 | 1.4 | | | | | | | | | 1.4 | | | | | | | |
| 2288 | 55.0 | 24.7 | | | | | | | | | | 20.3 | | | | | | | |
| 2289 | 62.5 | 26.6 | | | | | | | | | | 10.9 | | | | | | | |
| 2290 | 66.7 | 27.6 | | | | | | | | | | 5.7 | | | | | | | |
| 2291 | 60.1 | 38.5 | | | | | | | | | | 1.4 | | | | | | | |
| 2292 | 61.3 | 37.3 | | | | | | | | | | 1.4 | | | | | | | |
| 2293 | 55.2 | 44.8 | | | | | | | | | | | | | | | | | |
| 2294 | 58.3 | 36.3 | | | | | | | | | | 5.4 | | | | | | | |
| 2339 | 59.8 | 39.9 | | | | | | | | | | 0.3 | | | | | | | |
| 2341 | 59.9 | 40.0 | | | | | | | | | | 0.1 | | | | | | | |
| 2358 | 65.4 | 34.5 | | | | | | | | | | 0.08 | | | | | | | |
| 2359 | 71.2 | 28.7 | | | | | | | | | | 0.08 | | | | | | | |
| 2360 | 65.3 | 34.4 | | | | | | | | | | 0.3 | | | | | | | |
| 2361 | 71.1 | 28.6 | | | | | | | | | | 0.3 | | | | | | | |
| CE-1 | 90 | 10.0 | | | | | | | | | | | | | | | | | |
| CE-2 | 100 | | | | | | | | | | | | | | | | | | |

FIG. 6B

Table 2

| Alloy | Processable? | Hardness (HK) | | Lamellar wavelength (nm) |
|---|---|---|---|---|
| | | Homogenized, 1400°C | Aged, 700°C | |
| 2147 | Yes | 251 | 407 | 484 |
| 2148 | Yes | 388 | 605 | 180 |
| 2179 | Yes | 278 | 511 | 214 |
| 2180 | Yes | 382 | 639 | 111 |
| 2181 | Yes | 388 | **A** | **A** |
| 2182 | Yes | 364 | 540 | 177 |
| 2183 | Yes | 387 | 567 | 176 |
| 2184 | Yes | 396 | 557 | 184 |
| 2185 | Yes | 358 | **A** | **A** |
| 2186 | Yes | 332 | 663 | 153 |
| 2187 | Yes | 378 | 687 | 142 |
| 2188 | Yes | 375 | **A** | **A** |
| 2189 | No | 357 | **C** | **C** |
| 2190 | Yes | 390 | **A** | **A** |
| 2191 | Yes | 345 | **A** | **A** |
| 2192 | Yes | 392 | 626 | 152 |
| 2216 | Yes | 410 | 773 | 78 |
| 2217 | Yes | 383 | **A** | **A** |
| 2218 | Yes | 403 | 655 | 110 |
| 2219 | Yes | 378 | 710 | 98 |
| 2220 | Yes | 367 | **B** | 210 |
| 2221 | Yes | 382 | 683 | 103 |
| 2222 | No | 379 | **C** | **C** |
| 2223 | Yes | 409 | 704 | 77 |
| 2224 | No | 369 | **C** | **C** |
| 2225 | No | 368 | **C** | **C** |
| 2226 | No | 378 | **C** | **C** |
| 2236 | Yes | 373 | 780 | 78 |
| 2246 | Yes | 324 | 655 | 120 |
| 2247 | Yes | 335 | 687 | 105 |
| 2248 | Yes | 382 | 730 | 88 |
| 2249 | Yes | 396 | 731 | **A** |
| 2250 | Yes | 338 | 623 | **A** |
| 2251 | Yes | 342 | 640 | 143 |
| 2252 | Yes | 360 | 702 | 103 |
| 2253 | Yes | 352 | 640 | 110 |
| 2288 | Yes | 356 | **A** | **A** |
| 2289 | Yes | 346 | 600 | **D** |
| 2290 | Yes | 305 | 603 | **D** |
| 2291 | Yes | 356 | 746 | **D** |

FIG. 7A

Table 2 (cont.)

| Alloy | Processable? | Hardness (HK) | | Lamellar wavelength (nm) |
|---|---|---|---|---|
| | | Homogenized, 1400°C | Aged, 700°C | |
| 2292 | Yes | 352 | 693 | **D** |
| 2293 | Yes | 423 | 775 | 80 |
| 2294 | Yes | 393 | 767 | **D** |
| 2339 | Yes | 353 | 660 | 121 |
| 2341 | Yes | 346 | 623 | 114 |
| 2358 | Yes | 284 | 525 | 189 |
| 2359 | Yes | 266 | 451 | 191 |
| 2360 | Yes | 289 | 593 | 168 |
| 2361 | Yes | 256 | 487 | 120 |
| CE-1 | Yes | 138 | **A** | **A** |
| CE-2 | Yes | 105 | **A** | **A** |

FIG. 7B

FIG. 9A
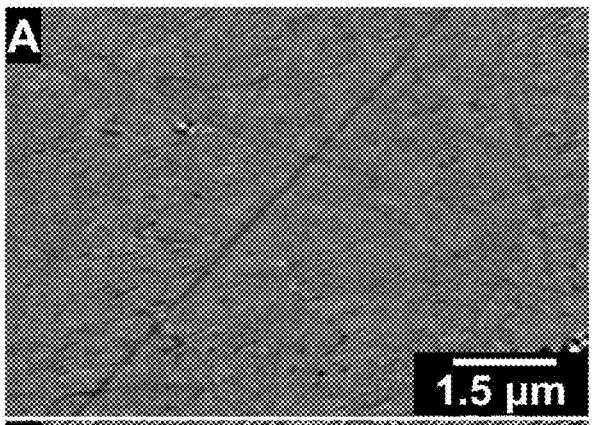
FIG. 9B
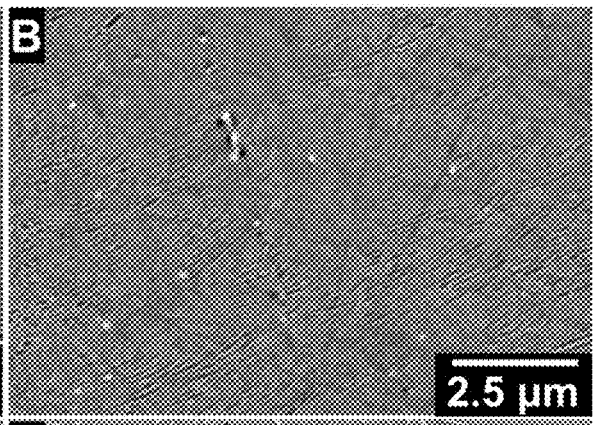
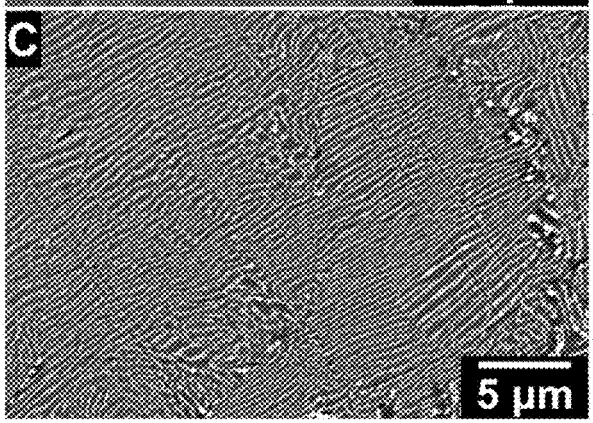
FIG. 9C
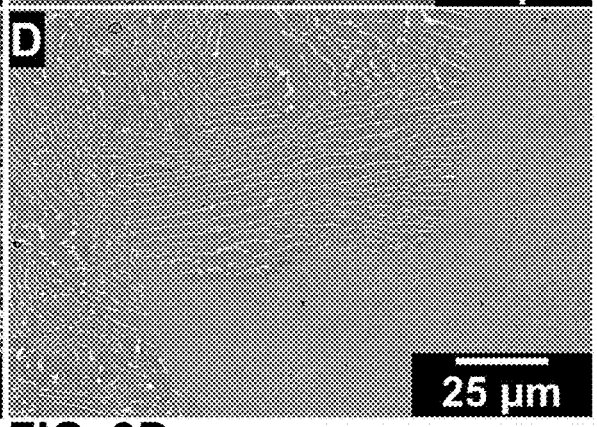
FIG. 9D

NICKEL-RUTHENIUM-BASED TERNARY OR GREATER ALLOYS, PRODUCTS COMPRISING THE SAME, AND METHODS OF MAKING AND USING THE SAME

CROSS-REFERENCE TO RELATED APPLICATIONS

This application claims priority to U.S. provisional patent application No. 63/415,348, filed Oct. 12, 2022 and U.S. provisional patent application No. 63/472,001, filed Jun. 9, 2023, each of which is incorporated by reference herein, in the entirety and for all purposes.

BACKGROUND

Probes are often used to test integrated circuits at multiple points during production, such as at least one of a partially fabricated state on a wafer, a finished state on the wafer, or after packaging. Examples of materials often used in such probes comprises Paliney® H3C (an alloy of silver, palladium, and copper), Paliney® 7 (an alloy of silver, palladium, copper, gold, platinum, and zinc), Paliney® 25 (an alloy of palladium, copper, silver, and rhenium), other palladium-silver-copper alloys, C17200 (a copper-beryllium alloy), C17500 (copper-beryllium-cobalt alloy), C51000 (a phosphor-bronze alloy), and W1 tool steel. Materials based on copper or iron would develop a high contact resistance if left bare, so they are typically electroplated. In some cases, they may be first plated with a layer of nickel, and second with a layer of gold, gold-nickel, or gold-cobalt. In other instances, they may be plated with a high hardness electrodeposited alloy of palladium, such as palladium-nickel or palladium-cobalt. In exceptional cases, the copper-based tips may be plated with rhodium.

SUMMARY

Features from any of the disclosed embodiments may be used in combination with one another, without limitation. In addition, other features and advantages of the present disclosure will become apparent to those of ordinary skill in the art through consideration of the following detailed description and the accompanying drawings.

In an embodiment, a nickel and ruthenium-based alloy is disclosed. The nickel and ruthenium-based alloy comprises nickel at about 48 to about 71 wt % of the alloy, ruthenium at about 17 to about 45 wt % of the alloy, and at least one ternary or higher addition at greater than zero to about 20 wt % of the alloy. The ternary or higher addition comprising gold, cobalt, chromium, copper, iridium, molybdenum, niobium, palladium, platinum, rhenium, rhodium, tantalum, vanadium, tungsten, or any combination thereof.

In an embodiment, the nickel is present at about 54 to about 71 wt % of the alloy.

In an embodiment, the nickel is present at about 50 to about 60 wt % of the alloy.

In an embodiment, the ruthenium is present at about 27 to about 45 wt % of the alloy.

In an embodiment, the ruthenium is present at about 25 to about 40 wt % of the alloy.

In an embodiment, the at least one ternary or higher addition are present at about 0.1 to about 6 wt % of the alloy.

In an embodiment, the at least one ternary or higher addition are present at about 0.7 to about 11 wt % of the alloy.

In an embodiment, the at least one ternary or higher addition are present at about 1.4 to about 15 wt % of the alloy.

In an embodiment, the at least one ternary or higher addition comprises gold.

In an embodiment, the alloy is age hardened.

In an embodiment, the alloy exhibits a Knoop microhardness of about 500 or more.

In an embodiment, the alloy exhibits a Knoop microhardness of about 600 or more.

In an embodiment, the alloy exhibits an average lamellar wavelength of about 150 nm or less.

In an embodiment, a test probe or test probe component comprising the nickel-ruthenium-based alloy is disclosed.

In an embodiment, the probe is configured as a cobra probe, a cantilever probe, a pogo pin probe, a LED probe, a vertical probe, or a MEMS probe.

In an embodiment, probe card is disclosed comprising the test probe or test probe component.

In an embodiment, a method of producing a nickel-ruthenium-based alloy is disclosed. The method comprises forming the alloy. The alloy comprises nickel at about 48 to about 71 wt % of the alloy, ruthenium at about 17 to about 45 wt % of the alloy, at least one ternary or higher addition at greater than zero to about 20 wt % of the alloy. The at least one ternary or higher addition comprises gold, cobalt, chromium, copper, iridium, molybdenum, niobium, palladium, platinum, rhenium, rhodium, tantalum, vanadium, tungsten, or any combination thereof.

In an embodiment, the method further comprises homogenizing the alloy after forming the alloy.

In an embodiment, the method further comprises age hardening the alloy at a temperature between about 600 and about 1,300° C.

In an embodiment, the method further comprises shaping the alloy into a desired shape before age hardening the alloy.

In an embodiment, the method further comprises age hardening the alloy at a temperature between about 700 and about 850° C.

BRIEF DESCRIPTION OF THE DRAWINGS

The drawings illustrate several implementations of the present disclosure, where identical reference numerals refer to identical or similar elements or features in different views or embodiments shown in the drawings.

FIGS. 6A and 6B illustrate Table 1.

FIGS. 7A and 7B illustrate Table 2.

FIGS. 9A-9D are images taken from Alloy 2236, Alloy 2148, Alloy 2179, and Alloy 2147, respectively, showing the various wavelength in the discontinuously precipitated microconstituents thereof.

DETAILED DESCRIPTION

Figure 1:
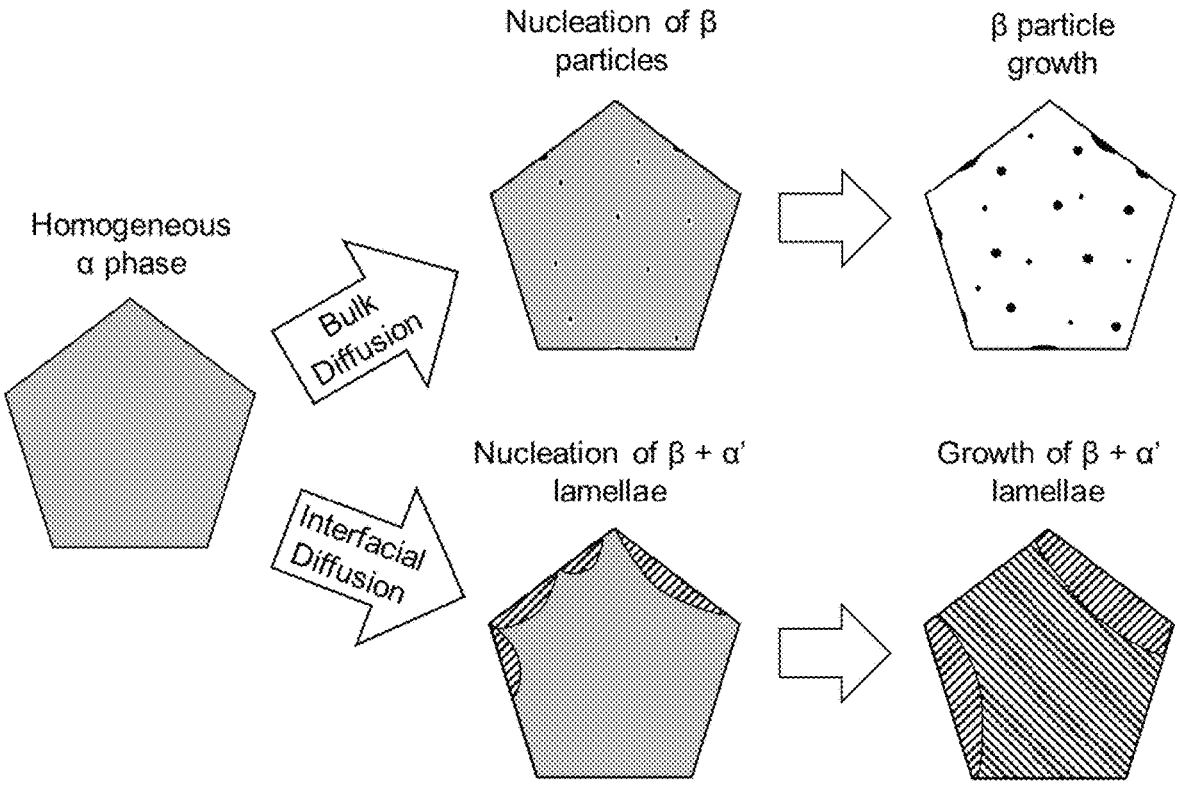
FIG. 1 is a schematic illustration of structural changes that occur in a homogenous phase undergoing continuous precipitation (labeled "bulk diffusion") and discontinuous precipitation (labeled "interfacial diffusion") during age hardening.

Nickel-ruthenium-based ternary or greater alloys, products, and methods of making and using the same are disclosed herein. An example nickel-ruthenium-based ternary or greater alloy ("Ni—Ru ternary or higher alloy") includes nickel at about 48 to about 71 weight % ("wt %") of the alloy, ruthenium at about 17 to about 45 wt % of the alloy, and at least one ternary or higher addition ("ternary or higher addition") at about 0.1 to about 20 wt % of the alloy. The ternary or higher addition may include gold, cobalt, chromium, copper, iridium, molybdenum, niobium, palladium, platinum, rhenium, rhodium, tantalum, vanadium, tungsten, or any combination thereof. The Ni—Ru ternary or higher alloy may be age-hardenable and exhibit a hardness greater than 500 hardness Knoop ("HK") after age hardening. The alloys may be used in electronic test probe applications.

The Ni—Ru ternary or higher alloy may be workable and formable. The alloy may be age hardenable. The alloy may exhibit mechanical properties with unexpectedly high Knoop hardness levels in excess of 500 hardness Knoop ("HK") after age hardening, and in some embodiments can exceed 600 HK. It is noted that, unless otherwise stated herein, the "hardness" refers to the average microhardness of the Ni—Ru ternary or higher alloy. The hardness of the Ni—Ru ternary or higher alloy may be measured using any suitable technique, such as using testing polished (e.g., having a surface roughness of about 1 μm RMS) sections of the Ni—Ru ternary or higher alloy. It is noted that the Ni—Ru ternary or higher alloy may be a ternary alloy (e.g., Ni—Ru—X), a quaternary alloy (e.g., Ni—Ru—$X_1$-$X_2$), and so forth.

It has been found that the Ni—Ru ternary or higher alloys disclosed herein are an improvement over nickel-ruthenium binary alloys and nickel-ruthenium ternary alloys having compositions that are different than the Ni—Ru ternary or higher alloys disclosed herein. For example, it has been found that nickel-ruthenium binary alloys exhibit an age hardened hardness of about 360 on the Vickers scale (about 365 HK). In another example, it has been found that nickel-ruthenium ternary alloys that include zirconium or titanium form alloys that are extremely brittle and are difficult to process. However, the Ni—Ru ternary or higher alloys disclosed herein exhibit a hardness that is significantly greater than the nickel-ruthenium binary alloy and is less brittle and more workable than the nickel-ruthenium ternary alloys that include zirconium or titanium. In another example, conventional nickel-ruthenium-platinum alloys are disclosed in Glaner (Glaner L., *A study of the Ni-Pt-Ru and Co-Pt-Ru systems*, University of the Witzetersrand (2009)). The nickel-ruthenium-platinum alloys expressly discussed in Glaner do not appear to fall within the ranges of the Ni—Ru ternary or higher alloys disclosed herein. The nickel-ruthenium-platinum alloys of Glaner exhibit two dendritic phases that cause the nickel-ruthenium-platinum alloys thereof to exhibit regions of high and low hardness. Further, the nickel-ruthenium-platinum alloys of Glaner are not homogenized and are instead annealed. As such, the nickel-ruthenium-platinum alloys of Glaner do not exhibit the optimized hardness of the Ni—Ru ternary or higher alloys disclosed herein. For instance, the hardness of the nickel-ruthenium-platinum alloys of Glaner depend on the hardness of the secondary phases thereof while the hardness of the Ni—Ru ternary or higher alloys disclosed herein depend, in part, on the high interface density engendered by fine lamellae and optimal thermal practices. In another example, U.S. Pat. No. 2,105,312 ("the '312 Patent") discloses palladium-based nickel-ruthenium-platinum alloys that do not fall within the ranges of the Ni—Ru ternary or higher alloys disclosed herein. The nickel-ruthenium-platinum alloys of the '312 Patent use nickel and ruthenium to harden the palladium. Meanwhile, the Ni—Ru ternary or higher alloys disclosed herein are nickel-based alloys that, in part, use the nickel/ruthenium interfaces to harden the alloy and ternary or higher additions to change kinetics of and improve nobility (e.g., less likely to oxidize, corrode, etc.) of the Ni—Ru ternary or higher alloy.

As will be discussed in more detail below, the Ni—Ru ternary or higher alloys disclosed here may be age hardened. Generally, two types of age hardening precipitation reactions are common in concentrated metal solid solutions: continuous precipitation ("CP") and discontinuous precipitation ("DP"). FIG. 1 is a schematic illustrating the structural changes that occur in a homogenous phase undergoing CP (labeled "bulk diffusion") and DP (labeled "interfacial diffusion") during age hardening. In CP, bulk diffusion dominates and precipitates globally on heterogeneous and homogeneous nucleation sites. As time progresses, solute in the matrix precipitate out of solution and the composition "continuously" evolves to the equilibrium compositions. DP emerges differently, as it is dominated by interfacial diffusion and can only form on a heterogeneous nucleation sites. Once a colony nucleates, a reaction front proceeds into the matrix and provides atoms a facile diffusion pathway. The evolution $\alpha \rightarrow \alpha' + \beta$ happens suddenly, locally, and "discontinuously." The DP reaction may also be referred to as "decomposition" of the α phase; retained α phase may be referred to as "undecomposed."

DP gives rise to a lamellar microstructure of alternating "plates" instead of more common particle shapes associated with precipitation. The spacing of these "plates" creates additional interfaces that impedes dislocation movement and consequently improves hardness. Generally, it is believed that CP reactions are inherently finer than DP reactions; however only Alloy 2288 (see Table 1) exhibited CP. The resulting Widmanstatten plates were formed from prolonged exposure to 900° C. and lacked facile heterogeneous nucleation sites. The sluggish kinetics are not conducive to ultrafine precipitates. The Lamellar microstructure appears and behaves similarly to eutectoid decomposition in other systems (e.g., iron-silicon-germanium, Paliney® 7, pearlitic steel, copper-aluminum, etc.). DP has been observed in the Ni-rich region of a Ni—Ru binary although the resultant Vickers hardness was only about 360 HV.

Nickel may form about 48 to about 71 wt % of the Ni—Ru ternary or higher alloys disclosed herein, such as in ranges of about 54 to about 71 wt %, about 50 to about 60 wt %, about 48 to about 52.5 wt %, about 50 to about 55 wt %, about 52.5 to about 57.5 wt %, about 55 to about 60 wt %, about 57.5 to about 62.5 wt %, about 60 to about 65 wt %, about 62.5 to about 67.5 wt %, or about 65 to about 70 wt %. The amount (i.e., weight percent) of nickel present in the Ni—Ru ternary or higher alloys disclosed herein may be selected based on a number of factors. In an example, it has been found that the wrought processability of the alloy depends, in part, on the amount of nickel present in the Ni—Ru ternary or higher alloy. In particular, it has been found that increasing the amount of nickel in the alloy generally makes the Ni—Ru ternary or higher alloy more wrought processable, and vice versa. As such, the amount of nickel in the Ni—Ru ternary or higher alloy may be selected based on the desired wrought processability of the alloy. In an example, the amount of nickel in the Ni—Ru ternary or higher alloy may depend on the ternary or higher addition present in the alloy. For instance, some ternary or higher additions may have a propensity to form nickel-rich or ruthenium-rich particles which may adversely affect the properties of the Ni—Ru ternary or higher alloy. In such an instance, the amount of nickel may be increased when the ternary or higher addition has a propensity to form solute-rich particles and/or when the ternary or higher addition has a propensity to form ruthenium-rich particles. In an example, the amount of nickel in the Ni—Ru alloy may be selected based on the desired amount of ruthenium and the ternary or higher addition in the Ni—Ru ternary or higher alloy, reasons for which will be discussed in more detail below.

Ruthenium may form about 17 to about 45 wt % of the Ni—Ru ternary or higher alloys disclosed herein, such as in ranges of about 27 to about 45 wt %, about 25 to about 40 wt %, about 17.5 to about 22.5 wt %, about 20 to about 25 wt %, about 22.5 to about 27.5 wt %, about 25 to about 30 wt %, about 27.5 to about 32.5 wt %, about 30 to about 35 wt %, about 32.5 to about 37.5 wt %, about 35 to about 40 wt %, about 37.5 to about 42.5 wt %, or about 40 to about 45 wt %. The amount of ruthenium present in the Ni—Ru ternary or higher alloys disclosed herein may be selected based on a number of factors. In an example, it has been found that the average lamellar wavelength caused by DP depends, in part, on the amount of ruthenium present in the Ni—Ru ternary or higher alloy. In particular, increasing the amount of ruthenium in the Ni—Ru ternary or higher alloy decreases the average lamellar wavelength and lowers the aging temperature (by increasing decomposition kinetics) of the Ni—Ru ternary or higher alloy and vice versa. As such, the amount of ruthenium that is present in the Ni—Ru ternary or higher alloy may be selected based in the desired average lamellar wavelength of the Ni—Ru ternary or higher alloy. It is noted that the hardness of the Ni—Ru ternary or higher alloy depends, in part, on the average lamellar wavelength (i.e., decreasing the average lamellar wavelength increases the hardness of the Ni—Ru ternary or higher alloy, and vice versa) and, as such, the amount of ruthenium in the Ni—Ru ternary or higher alloy may be selected based on the desired hardness of the Ni—Ru ternary or higher alloy. In an example, it has been found that increasing the amount of ruthenium in the Ni—Ru ternary or higher alloy increases the reaction front velocity at any given temperature. Thus, the amount of ruthenium in the Ni—Ru ternary or higher alloy may be selected based on the desired average lamellar wavelength. In an example, the amount of ruthenium may be selected based on the desired solid solution strength of the Ni—Ru ternary or higher alloy since, it has been found that increasing the amount of ruthenium in the Ni—Ru ternary or higher alloy increases the solid solution strength of the Ni—Ru ternary or higher alloy, and vice versa. In an example, the amount of ruthenium in the Ni—Ru ternary or higher alloy may be selected based on the desired wrought processing since it has been found that decreasing the amount of ruthenium in the Ni—Ru ternary or higher alloy makes the Ni—Ru ternary or higher alloy more wrought processable. In an example, the amount of ruthenium in the Ni—Ru ternary or higher alloy may be selected based on desired temperature of homogenization since it has been found that decreasing the amount of ruthenium in the Ni—Ru ternary or higher alloy allows the temperature of homogenization to be decreased, and vice versa. In an example, the amount of ruthenium in the Ni—Ru ternary or higher alloy may be selected based on the desired amount of nickel and the ternary or higher addition in the Ni—Ru ternary or higher alloy.

Figure 12:
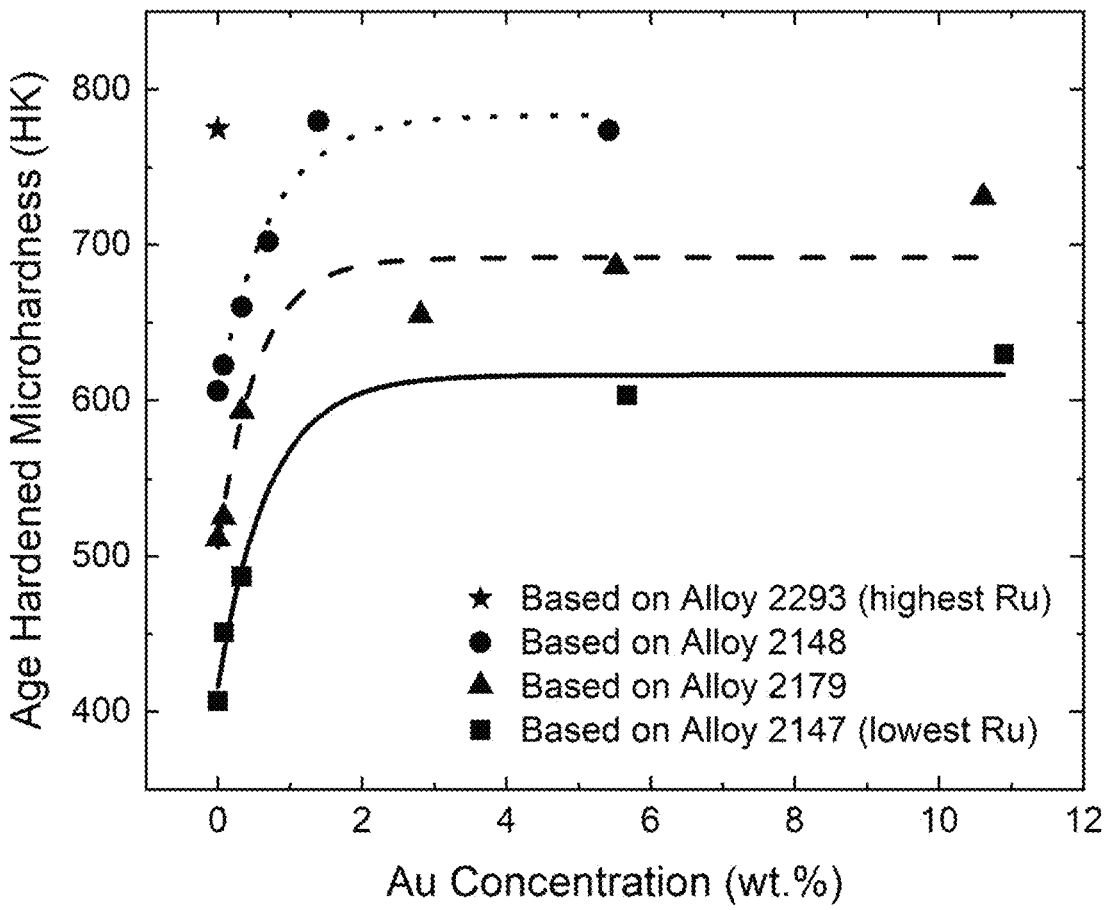
FIG. 12 is a graph illustrating the effect of gold ternary addition to the nickel-ruthenium matrix after age hardening.

The ternary or higher addition may form greater than zero to about 20 wt % of the Ni—Ru ternary or higher alloys disclosed herein, such as in ranges of about 0.08 to about 6 wt %, about 0.7 to about 11 wt %, about 1.4 to about 15 wt %, about 0.01 to about 0.05 wt %, about 0.03 to about 0.08 wt %, about 0.05 to about 0.1 wt %, about 0.08 to about 0.15 wt %, about 0.1 to about 0.2 wt %, about 0.15 to about 0.25 wt %, 0.2 to about 0.3 wt %, about 0.25 wt % to about 0.4 wt %, about 0.3 to about 0.5 wt %, about 0.4 to about 0.75 wt %, about 0.5 to about 1 wt %, about 0.75 to about 1.25 wt %, about 1 to about 1.5 wt %, about 1.25 to about 1.75 wt %, about 1.5 to about 2 wt %, about 1.75 to about 2.5 wt %, about 2 to about 3 wt %, about 2.5 to about 3.5 wt %, about 3 to about 4 wt %, about 3.5 to about 4.5 wt %, about 4 to about 5 wt %, about 4.5 to about 6 wt %, about 5 to about 7 wt %, about 6 to about 8 wt %, about 7 to about 9 wt %, about 8 to about 10 wt %, about 9 to about 12 wt %, about 10 to about 14 wt %, about 13 to about 17 wt %, or about 16 to about 20 wt %. The amount of the ternary or higher addition may be selected based on a number of factors. In an example, the amount of the ternary or higher addition may depend on the particular element or elements that form the ternary or higher addition. In an example, the amount of the ternary or higher addition may depend on the amount of nickel and the amount of ruthenium in the Ni—Ru ternary or higher alloy and whether the ternary or higher addition has a propensity to form any nickel-rich or ruthenium-rich particles. However, it is generally noted that the amount of the ternary or higher addition may be generally selected to be about 0.08 wt % or greater. Generally, the effect the ternary or higher addition have on the Ni—Ru ternary or higher alloy grows exponentially and even low concentrations exhibit a measurable improvement in microhardness. In an example, as shown in FIG. 12, adding 0.08% of a ternary or higher addition may increase the hardness of the Ni—Ru ternary or higher alloy by about 10%. It is noted that the ternary or higher addition may have a noticeable effect on the hardness of the Ni—Ru ternary or higher alloy. For example, it is believed that a ternary or higher addition forming about 0.5 wt % of the Ni—Ru ternary or higher alloy may increase the hardness of some compositions of the Ni—Ru ternary or higher alloys disclosed herein by more than 100 HK compared to a substantially similar nickel-ruthenium binary alloy. Similarly, it is believed that a ternary or higher addition forming about 0.25 wt % of the Ni—Ru ternary or higher alloy may cause some of the Ni—Ru ternary or higher alloys disclosed herein to exhibit a hardness greater than 650 HK. Also, it is generally noted that the amount of the ternary or higher addition is generally selected to be less than about 20 wt % since the ternary or higher addition generally adversely affect the Ni—Ru ternary or higher alloy when present in amounts greater than about 20 wt %, for instance, by forming ternary or higher addition-rich grain boundary decoration.

The ternary or higher addition may exhibit at least some differential solubility with nickel and/or ruthenium and cause the Ni—Ru ternary or higher alloy to exhibit beneficial properties. As previously discussed, the ternary or higher addition may include one or more of gold, cobalt, chromium, copper, iridium, molybdenum, niobium, palladium, platinum, rhenium, rhodium, tantalum, vanadium, or tungsten.

The ternary or higher addition may include platinum because it has been found that the amount of platinum in the Ni—Ru ternary or higher alloy may be used to control whether the age hardening process results in complete decomposition or partial decomposition which consists of decomposed phase along grain boundaries and undecomposed grain centers. For example, it has been found that selecting the amount of platinum in the Ni—Ru ternary or higher alloy to be less than 10 wt % and, more particularly, less than 7 wt % may result in complete decomposition of the Ni—Ru ternary or higher alloy during the age hardening process at certain Ni—Ru ternary or higher alloy compositions and during certain age hardening processes. Whereas increasing the amount of platinum in the Ni—Ru ternary or higher alloy to be greater than 7 wt % and, more particularly, greater than 10 wt % may result in only partial decomposition of the Ni—Ru ternary or higher alloy during the age hardening process at certain Ni—Ru ternary or higher alloy compositions and during certain age hardening processes. Platinum (and the other noble metals) may also increase the nobility of the Ni—Ru ternary or higher alloy.

Rhenium has low solubility in nickel and a high affinity of ruthenium. As such, rhenium may form large insoluble ruthenium rich particles, for example, when the amount of rhenium in the Ni—Ru ternary or higher alloy is greater than 9 wt % in certain Ni—Ru ternary or higher alloy compositions. Surprisingly, the insoluble ruthenium rich particles do not adversely affect the processability of the Ni—Ru ternary or higher alloy. The insoluble ruthenium rich particles may be used to reduce the volume faction of the lamellar microstructure by providing heterogeneous nucleation sites that promote uncoupled DP. As such, the amount of rhenium may be used to control the lamellar microstructure and, in turn, the hardness of the Ni—Ru ternary or higher alloy. It is noted that rhenium may form the insoluble ruthenium rich particles when the rhenium is present in amounts less than 9 wt % and/or at certain compositions of the Ni—Ru ternary or higher alloy (e.g., the Ni—Ru ternary or higher alloy includes ruthenium at or near 17 wt %).

The ternary or higher addition may include at least one of tungsten, molybdenum, tantalum, or niobium. The tungsten, molybdenum, tantalum, and niobium ternary or higher addition may improve the high temperature stability (e.g., creep resistance) of the Ni—Ru ternary or higher alloy. It has been found that tungsten, molybdenum, tantalum, and niobium effects colony growth and decomposition of the Ni—Ru ternary or higher alloy. As such, the composition of the Ni—Ru-x alloy (i.e., the amounts of nickel, ruthenium, and the ternary or higher addition in the Ni—Ru ternary or higher alloy), the homogenization treatment conditions, and the age hardening conditions may be selected such that tungsten, molybdenum, tantalum, and/or niobium beneficially effect instead of detrimentally effect colony growth and decomposition of the Ni—Ru ternary or higher alloy. It is further noted that selecting the niobium to be relatively low (e.g., less than 1.5 wt %) may make melting and casting of the Ni—Ru ternary or higher alloy difficult. As such, in some examples, the amount of niobium in the Ni—Ru ternary or higher alloy may be selected to be greater than 1.5 wt %. It is noted that the Ni—Ru ternary or higher alloy may include less than 1.5 wt % when formed using certain processing parameters and/or when the Ni—Ru ternary or higher alloy includes one or more ternary or higher additions in addition to niobium. with In an embodiment, the ternary or higher addition may include palladium. The palladium ternary or high addition may prevent or at least inhibit the formation of a pseudo-eutectic phase which, in turn, may increase the nobility of the Ni—Ru ternary or higher alloy. It has been found that palladium effects the melting of the Ni—Ru ternary or higher alloy during homogenization treatments, the formation of grain boundaries with nickel pseudo-eutectic phases, and formation of pores. As such, the composition of the Ni—Ru ternary or higher alloy comprising palladium and the homogenization treatment conditions may be selected such that palladium beneficially effects instead of detrimentally effects melting of the Ni—Ru ternary or higher alloy during homogenization treatments, the formation of grain boundaries with nickel pseudo-eutectic phases, and the formation of pores. For example, some compositions of the Ni—Ru ternary or higher alloy comprising palladium formed using homogenization treatments exhibiting a temperature greater than 1400° C. may induce non-equilibrium melting of the Ni—Ru ternary or higher alloy during homogenization heat treatments, form significant grain boundary decorations with palladium-nickel pseudo-eutectic phases, and form pores. As such, for instance, the homogenization heat treatment may be selected to include heating the Ni—Ru ternary or higher alloy comprising palladium to a temperature that is less than 1400° C. (e.g., about 1200° C.).

The ternary or higher addition may include rhodium because it has been found that rhodium enables rapid colony growth and at least partial (e.g., complete) decomposition during age hardening treatments. Further, rhodium may detrimentally cause the formation of coarse lamellae and equiaxed particles from over-aging.

The ternary or higher addition may include gold. Gold is miscible with nickel at high temperatures, immiscible with nickel at low temperatures, and immiscible with ruthenium. In addition, gold may be an efficient lamellar refiner, may increase the reaction front velocity, may encourage quick decomposition of the Ni—Ru ternary or higher alloy during age hardening, and may create heterogeneous nucleation sites within alloy grains. For example, it was observed that gold coerced fine lamellar structures in the Ni—Ru ternary or higher alloy during age hardening treatments exhibiting a temperature of about 700° C. Gold may also allow the Ni—Ru ternary or higher alloy to be highly processable. It is noted that Ni—Ru ternary or higher alloy comprising high amounts of gold and ruthenium may cause the formation of ruthenium-rich and gold-rich microconstituents and may inhibit complete homogenization of the Ni—Ru ternary or higher alloy at 1400° C. For example, alloys 2288, 2289, 2248, 2247, and 2294 exhibited ruthenium-rich and gold-rich microconstituents. The compositions of Alloys 2288, 2289, 2248, 2247, and 2294 are provided in Table 1 of FIGS. 6A and 6B, for ease of illustration. The mutual immiscibility of ruthenium and gold in the nickel matrix produces a competition for solid solubility. For example, increasing ruthenium concentration reduces gold solubility and increasing gold concentration decreases ruthenium solubility. Saturation and the formation of gold rich and ruthenium rich regions occurs above: 1.5 wt % Au in Alloy 2248 based alloys, 3 wt % Au for Alloy 2179 based alloys, and 5.5 wt % Au for Alloy 2147 based alloys. However, it was surprisingly found that the high amounts of gold and ruthenium do not adversely affect the processability of the Ni—Ru ternary or higher alloy. The compositions of Alloy 2248, 2179, and 2147 are provided in Table 1 of FIGS. 6A and 6B. It is noted that gold may have a significant effect on the age hardened microhardness of the Ni—Ru ternary or higher alloy even at low concentrations. For example, as shown in FIG. 12, additions of 0.08 wt % of gold in the Ni—Ru ternary or higher alloy based on alloy 2147 increases the age hardened microhardness from about 400 HK to about 450 HK thereby demonstrating the effect gold has on the microhardness of the Ni—Ru ternary or higher alloy even at low concentrations of gold.

The ternary or higher addition may include cobalt and/or iridium. Cobalt and iridium exhibit high solubility with both nickel and ruthenium. It has been found that cobalt and iridium may encourage homogenization of the Ni—Ru ternary or higher alloy without ejecting ruthenium or forming precipitates. It has also been found that Ni—Ru ternary or higher alloy alloys including cobalt and/or iridium exhibit good processability. Further, it has been found that relatively high amounts of cobalt (e.g., cobalt forms about 12 wt % or more of the Ni—Ru ternary or higher alloy) in the Ni—Ru ternary or higher alloy may cause a blue oxide layer to form on the alloy and may cause the alloy to be magnetic after age hardening.

In an embodiment, the ternary or higher addition may include chromium. It has been found that chromium effects the microstructure by increasing the volume fraction of Ru-rich phase upon homogenization and thereby increasing population of heterogeneous nucleation sites. As such, the composition of the Ni—Ru ternary or higher alloy (e.g., the amounts of nickel, ruthenium, and chromium) and the homogenization treatment may be selected such that chromium beneficial effects instead of detrimentally effects the microstructure and the population of heterogeneous nucleation sites. For example, some compositions of the Ni—Ru ternary or higher alloy comprising nickel forming using certain homogenization treatments may cause the alloy to exhibit ruthenium-rich in the as-cast microstructure that may coarsen into mesoscale two-phase microstructures.

In an embodiment, the ternary or higher addition may include vanadium. It has been found that vanadium harms the processability but promotes decomposition of the Ni—Ru ternary or higher alloy during age hardening. It is noted that vanadium may cause some melting in the Ni—Ru ternary or higher alloy during a homogenization treatment exhibiting temperatures of about 1400° C. Surprisingly, it has been found that such melting does not adversely affect the processability of the alloy.

The ternary or higher addition may include copper. Copper may improve the processability Ni—Ru ternary or higher alloy and may refine the lamellar structure of the alloy after age hardening. It is noted that certain compositions of the Ni—Ru ternary or higher alloy including copper may melt during the homogenization treatment and form coarse particles upon solidification. However, it was surprisingly found that the Ni—Ru ternary or higher alloy comprising the coarse particles remained processable. It is noted that copper may increase the microhardness of the Ni—Ru ternary or higher alloy in a manner similar to gold.

As previously discussed, the Ni—Ru ternary or higher alloy may include two or more ternary or higher additions. The two or more ternary or higher additions may allow the Ni—Ru ternary or higher alloy to exhibit the benefits of each of the two or more ternary or higher additions. For example, a Ni—Ru ternary or higher alloy that includes both gold and platinum may exhibit the benefits of gold (e.g., an efficient lamellar refiner) and the benefits of platinum (e.g., increasing the nobility of the alloy).

The Ni—Ru ternary or higher alloy may be free or substantially free of one or more elements. In an example, the Ni—Ru ternary or higher alloy may be free or substantially free of lead, mercury, and cadmium. In an example, the alloy may be free or substantially free of zirconium since zirconium may form zirconium-rich precipitates that impede or prevent the processability of the Ni—Ru ternary or higher alloy. In an example, the alloy may be free of substantially free of titanium since titanium forms an undesirable low melting temperature eutectic microconstituents and causes the Ni—Ru alloy to be easily oxidized. In an embodiment, the alloy may be free or substantially free of carbon or silicon. In an example, the alloy may be free of iron or zirconium. In an example, the alloy may be free or substantially free of one or more of any of the ternary or higher additions disclosed herein. For instance, some ternary additions may adversely interact with each other, low concentrations of some ternary additions (e.g., niobium) may be detrimental, and/or maintaining the ternary or higher addition below a desired amount may require omitting at least one ternary addition. It is noted that "substantially free" encompasses trace amounts of the elements that do not otherwise affect the material properties of the alloy (e.g., about 0.6 wt % or less, about 0.4 wt % or less, or about 0.2 wt % or less).

The Ni—Ru ternary or higher alloy may include one or more impurities forming about 0.6 wt % or less, about 0.4 wt % or less, or about 0.2 wt % or less.

In an embodiment, the Ni—Ru ternary or higher alloy may include elements in addition to nickel, ruthenium, the ternary addition, and, optionally, one or more impurities and/or structurally insignificant oxide layers. Such elements may include iron, rhodium, osmium, platinum, iridium, cobalt, copper, or sulfur. In an embodiment, the Ni—Ru alloy may only include nickel, ruthenium, one or more ternary or higher additions disclosed herein, and, optionally, one or more impurities and/or structurally insignificant oxide layers.

The Ni—Ru ternary or higher alloy may be formed using any suitable technique. In an embodiment, the alloy may be formed by mixing and alloying the individual elements together. For example, the alloy may be formed by mixing nickel, ruthenium, and the ternary addition together in either their elemental and/or precursor forms. After mixing the nickel, ruthenium, and ternary or higher additions together, the method may involve alloying the nickel, ruthenium and ternary or higher additions together using any suitable technique, such as casting.

Figure 2A:
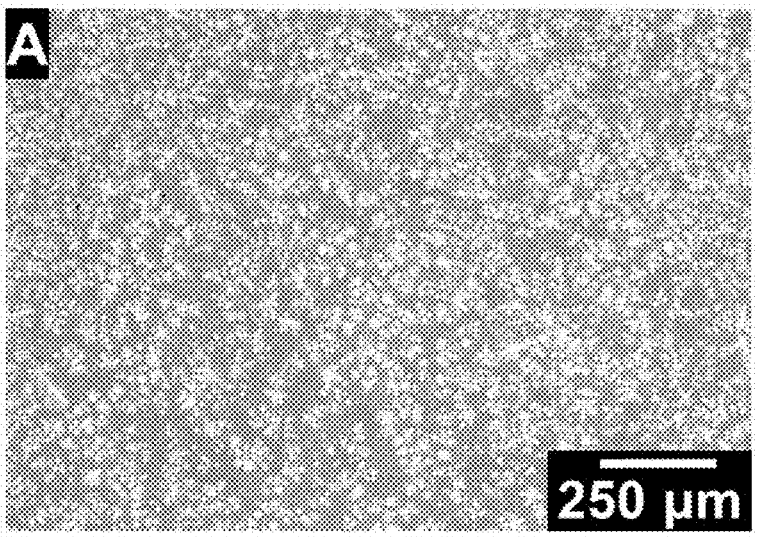
FIGS. 2A and 2B are images of Ni—Ru ternary alloys, Alloy 2189 and Alloy 2187, respectively, showing the dendritic microstructure of the as-cast alloys.
Figure 2B:
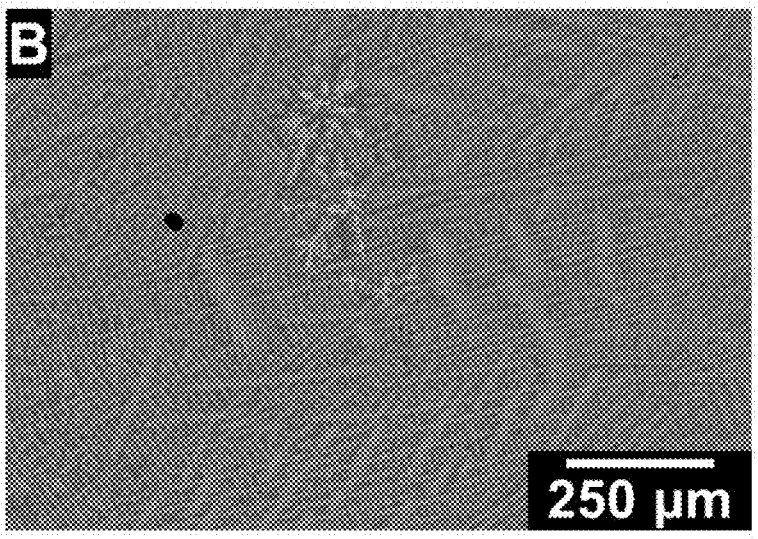

It has been found that the Ni—Ru ternary or higher alloy may include at least one of copious cored Ru-rich or Ni-rich dendrites, microsegregation (composition variations that result from solidification), or particles having different crystal structures which, in some configurations, may be deleterious to processing. Depending on the concentration and elements present in each Ni—Ru ternary or higher alloy, copious cored ruthenium-rich or nickel-rich dendrites may be the principal as-cast microconstituents. For example, FIGS. 2A and 2B are images of Alloy 2189 and Alloy 2187, respectively, showing the dendritic microstructure of the as-cast alloys. The compositions of Alloy 2189 and Alloy 2187 are shown in Table 1 (provided in FIG. 6A) and are discussed in more detail in the Working Examples. In some embodiments, the Ni—Ru ternary or higher alloy may be subjected to a homogenization process after forming the Ni—Ru alloy such that the Ni—Ru ternary or higher alloy exhibits a single phase (e.g., a face centered cubic phase). The homogenization process may include heating the Ni—Ru ternary or higher alloy at temperatures greater than about 900° C., such as greater than about 1000° C. or in ranges of about 900° C. to about 1100° C., about 1000 to about 1200° C., about 1100 to about 1300° C., about 1200 to about 1400° C., about 1300 to about 1500° C., or about 1400 to about 1550° C. The homogenization process may be performed in a reducing atmosphere (e.g., an $H_2$-3.5% atmosphere), an inert atmosphere, or any suitable other atmosphere. It has been found that the hardness that the Ni—Ru ternary or higher alloy exhibits after homogenization is substantially similar to the hardness of a substantially similar nickel-ruthenium binary alloy.

The Ni—Ru ternary or higher alloy may be processed and/or shaped after forming the Ni—Ru ternary or higher alloy (e.g., after homogenization). For example, the alloy may be processed and/or shaped into any of the probes disclosed below, a plate, a rod, a wire, or any other suitable shape. The alloy may be processed and/or shaped prior to age hardening since it is expected that the processing and/or shaping of the alloy may be best produced from a Ni—Ru ternary or higher alloy with microhardness less than about 500 HK.

In some embodiments, the Ni—Ru ternary or higher alloy may be age hardened, for example, after the homogenization process. As previously discussed, the age hardening of the alloy may be caused, at least in part, by DP reactions that form a lamellar structure. For example, it is believed the average lamellar wavelength and the resulting phase interface density is expected to play a role on resultant hardness of Ni—Ru—X alloys. While not desiring to be bound by a particular theory, the hardness of the Ni—Ru ternary or higher alloy may be governed by the Hall-Petch relation, which states that strength increases with decreasing grain, phase, and/or lamellar length scales.

Figure 3:
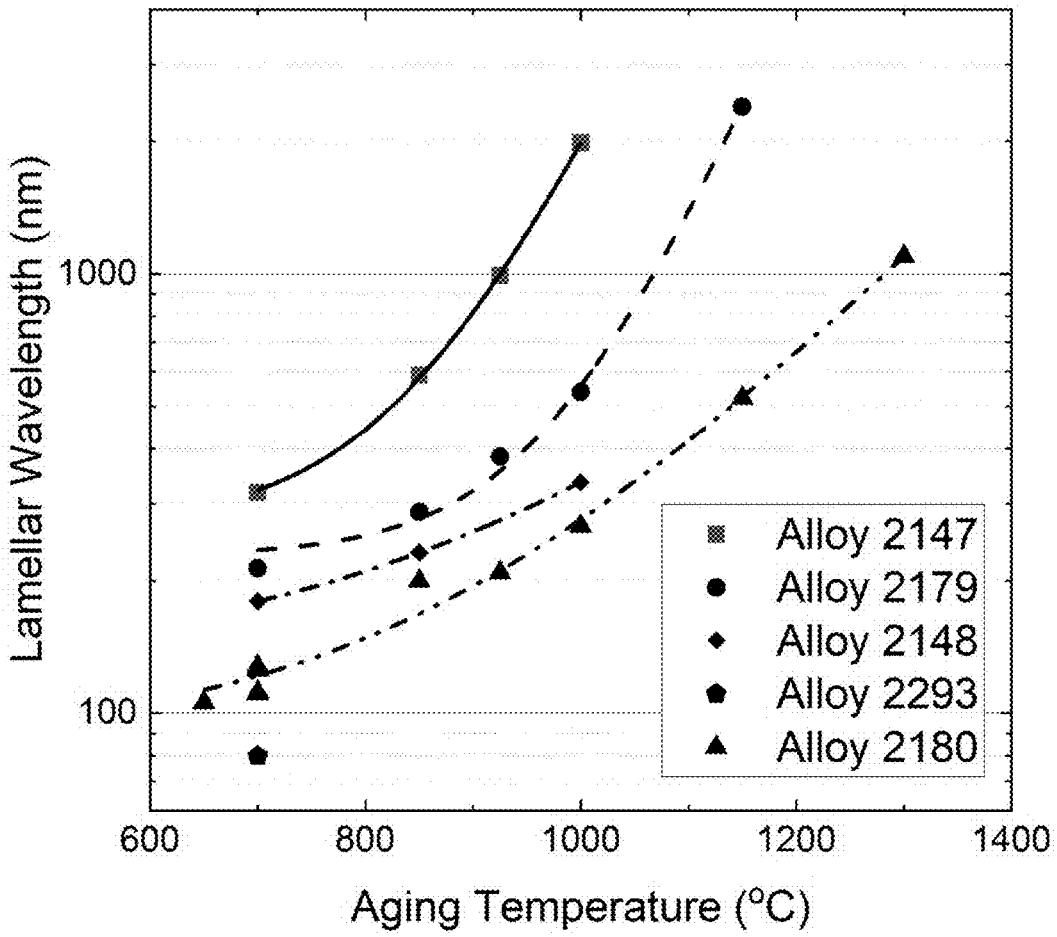
FIG. 3 is a graph illustrating the average lamellar wavelength of several Ni—Ru alloys demonstrating the relationship between aging temperature and average lamellar wavelength in Ni—Ru alloys.

The age hardening process may include heating the Ni—Ru ternary or higher alloy to temperatures greater than 600° C., such as in ranges of about 600 to about 800° C., about 700 to about 900° C., about 800 to about 1000° C., about 900 to about 1100° C., about 1000 to about 1200° C., or about 1100 to about 1300° C. It has been found that Ni—Ru ternary or higher alloys exhibit a nearly exponential relationship between aging temperature and average lamellar wavelength in the decomposed microconstituent. FIG. 3 is a graph illustrating the lamellar wavelength of several Ni—Ru binary alloys and a Ni—Ru ternary alloy (the compositions of these Ni—Ru alloys are shown in Table 1 of FIGS. 6A and 6B and will be discussed in more detail with regards to the Working Examples) demonstrating the relationship between aging temperature and average lamellar wavelength in Ni—Ru binary or higher alloys. It has also been found that increasing ruthenium concentration in the Ni—Ru alloy apparently has the effects of decreasing the average lamellar wavelength and increasing the reaction front velocity at lower temperatures. It is noted that there is a point of diminishing return for shortening average lamellar wavelength via aging parameters. For example, there may be constraints on average lamellar wavelengths for a given ruthenium concentration resulting from sluggish growth kinetics below about 600° C., and sluggish nucleation kinetics above about 1300° C. Exact temperatures under which DP takes place may vary based on alloy composition. It has also been found that aging the Ni—Ru ternary or higher alloy below the nickel-ruthenium solvus temperature does not guarantee decomposition per se.

In some embodiments, the Ni—Ru ternary or higher alloys disclosed herein may form probes, such as probes used to test integrated circuits. Such probes may test integrated circuits at multiple points during production. Different methodologies exist for contacting the test pads on these devices under test (DUTs). Probes come in myriad configurations, with some key types comprising vertical probes, buckling beam probes, pogo pin probes, cobra probes, cantilever probes, micro-electromechanical system (MEMS) probes, and light emitting diode (LED) probes. In an embodiment, the probes may form part of a probe card.

Figure 4A:
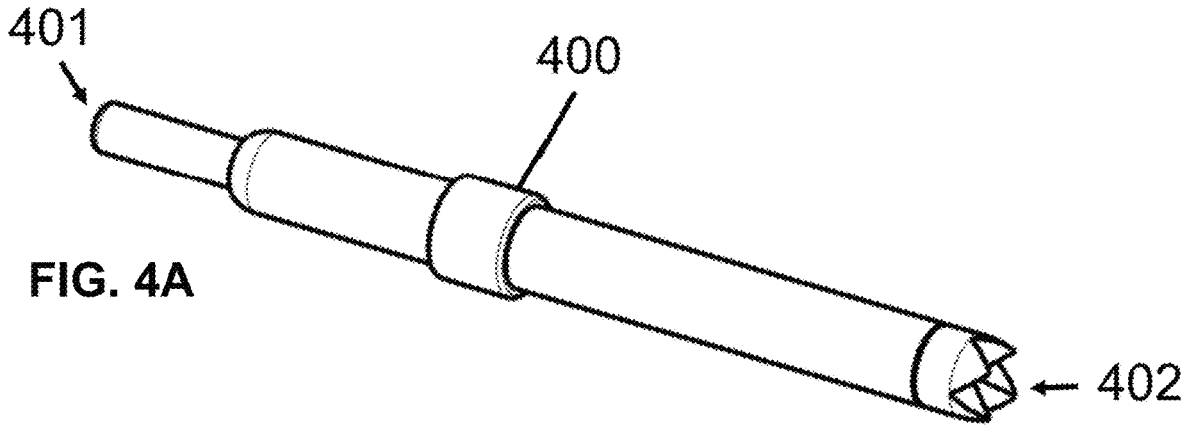
FIGS. 4A and 4B are an isometric view and a cross-sectional view of a pogo pin, according to implementations of the present disclosure.
Figure 4B:
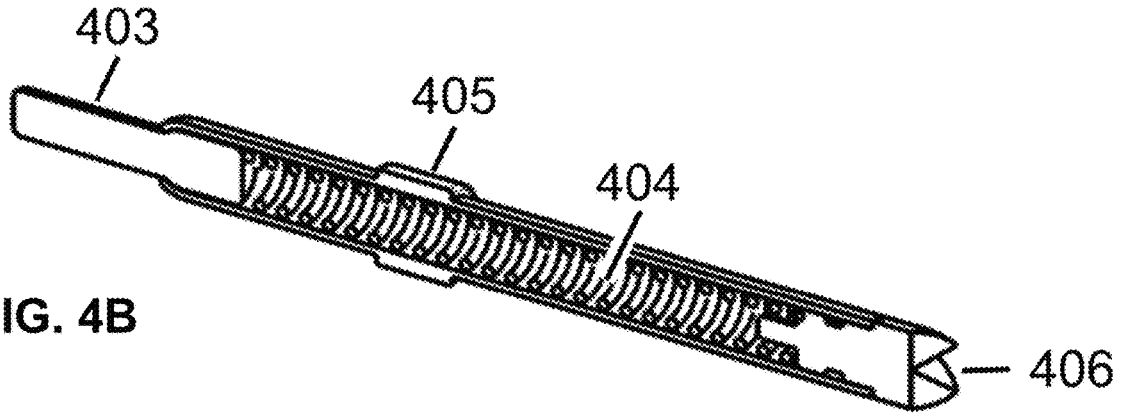

Pogo pins are used for testing and programing semiconductor devices. Other applications of the pogo pins may include contacting in flip-chip packaging, where the pogo pin has superior probe mark positional control relative to vertical probe or cantilever probes. FIGS. 4A and 4B are an isometric view and a cross-sectional view, respectively, of a pogo pin 400, according to an embodiment. The pogo pin 400 serves as a compliant connecting structure that provide electrical continuity between a proximal contact point 401 and distal contact point 402. The pogo pin 400 includes a plunger 403 that is configured to be pressed against the proximal contact point 401. The resultant force depresses a spring 404 inside the body 405 of the pogo pin 400. The spring 404 provides the requisite contact force to ensure electrical contact between the proximal contact point 401 and the probe plunger 403, and between the distal contact point 402 and the probe tip 406. The body 405 of the pogo pin 400 may include bronze, brass, or a high-copper alloy. The body 405 may be plated first with nickel, and secondly with gold. The spring 404 may be mild steel, stainless steel, or a high-copper alloy. In general, the distal contact point 402 mates with a metallic test point on the device under testing ("DUT").

The pogo pin 400 may use an aggressive wedge, crown, or castle tip on the distal contact point 402 to engage solder bumps. The tip 406 of the pogo pin 400 generally performs multiple simultaneous functions: maintains a low contact resistance, possesses bulk electrical conductivity, minimizes material adhesion from the DUT, and resists dulling of sharp features from abrasive cleaning (e.g., abrasive cleaning of the tip 406 may be needed between about every 200 to 2,000 touchdowns to remove adhered metal originating from the DUT). Forming the tip 406 from the Ni—Ru ternary or higher alloy allows the tip 406 of the pogo pin 400 to exhibit each of these functions because, in part, the Ni—Ru ternary or higher alloy exhibits a hardness greater than 500 HK.

Figure 5:
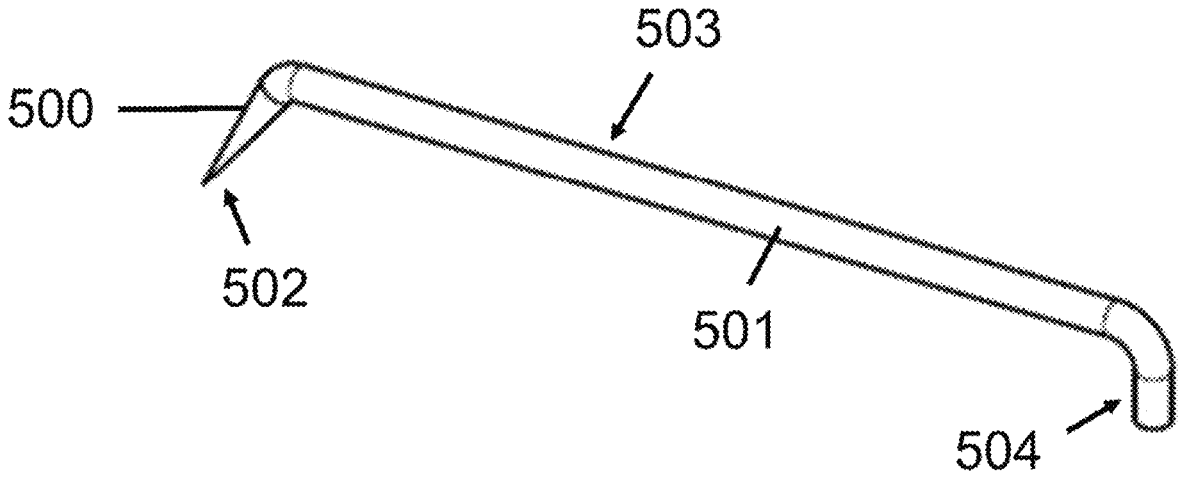
FIG. 5 is an isometric view of an LED probe, according to implementations of the present disclosure.

As previously discussed, another probe that may include the Ni—Ru ternary or higher alloy is an LED probe. The LED probe may include LED, mini-LED, micro-LED, or photodiodes. At the wafer through package die level, test pads on the DUT may be contacted by a set of LED probes, whereupon the diode is energized and emitted light collected and quantified. FIG. 5 is an isometric view of an LED probe 500, according to an embodiment. The LED probe 500 may include a wire 501 with diameters from about 50 to about 750 μm (e.g., about 50 to about 100 μm or about 250 to about 750 μm). The LED probe 500 also includes a distal tip 502 configured to contact the DUT ground at an acute angle, a body 503 comprising a portion that functions as a cantilever spring, and a proximal end 504 formed for affixing to the head of the photonic tester.

Periodic abrasive cleaning may be needed to clean the tip 502 of the LED probe 500 of any foreign contaminants that may give rise to high contract resistance. The cleaning process imposes a small amount of material removal on the tip 502 of the LED probe 500, thus dulling the probe tip 502 further with each cleaning cycle. As such, the tip 502 of the LED probe 500 may be formed from the Ni—Ru alloy because the relatively hardness of the Ni—Ru alloy resists wear of the tip 502 during cleaning.

COMPARATIVE AND WORKING EXAMPLES

A plurality of comparative examples (labeled Alloy 2147, Alloy 2148, Alloy 2179, CE-1, and CE-2) and working examples were manufactured via casting. The composition of each of the comparative and working examples are listed in Table 1. Table 1 is provided in FIGS. 6A and 6B. Each of the comparative examples were homogenized at 1400° C. in a mildly reducing atmosphere of $N_2$-3.5% $H_2$ and then age hardened at 700° C. for 2 hours. Table 2 lists the physical properties of the comparative and working examples of various Ni—Ru binary or higher alloys. Table 2 is provided in FIGS. 7A and 7B, for ease of illustration. The hardness of some of the comparative and working examples listed in Table 2 were measured after the homogenization and age hardening treatments.

The hardness of the comparative and working examples were measured on a LECO M-400 Hardness Tester. To measure the hardness, sections were taken from each of the listed alloy compositions. The sections were mounted in resin and polished using a 1 μm polishing medium. The hardness tester included diamond tipped, elongated pyramid shaped probe with a 100 gram-force load that was pressed into the prepared material surface. Once the probe was extracted, the indentation of the probe imprinted on the surface was measured. To ensure reliability, five indentations were measured at random and averaged values were reported.

It is noted that the hardness of some of the comparative and working examples were not measured because, as specified in Table 2, some alloys did not respond to the age hardening heat treatment or did so at a low volume fraction. For example, Table 2 lists some of the hardnesses of the comparative and working examples as A, B, C, or D. A indicates that the age hardening reaction was irregular or absent, B indicates that insufficient volume of the aged microstructure was present for the microhardness measurement, C indicates that the hardness was not measured due to poor processability, and D indicates that the hardness was not measured. It is noted that the alloys having a hardness of A, B, or C does not indicate that the alloys are not viable but, instead, merely indicates that one or more issues arose during processing that inhibited measuring the hardness of the alloys. It is believed that the alloys having a hardness of A, B, or C may still be viable by optimizing, for example, the composition of the alloy, the homogenization process used to form the alloy, or the age treatment process used to form the alloy.

The average lamellar wavelength of each of the comparative and working examples was measured after the age hardening treatments unless otherwise specified in Table 2. The average lamellar wavelength was determined from scanning electron microscopy images utilizing ImageJ and Matlab. An area with the shortest observed wavelength (this means the lamellar cross-section is perpendicular to the observed surface) was selected. A Fast Fourier Transform ("FFT") converted the selected image into the frequency domain where the brightest area (most common frequency) was selected and a reverse FFT was performed. This produced an image showing the lamellar phases (e.g., black for Ni and white for Ru). A line was drawn across the lamellae, the contrast differences were converted into a contrast spectrum, and this data was then loaded into Matlab. Code then finds the Ru lamellar interface and computes the spacing between them. Tables 1 and 2 demonstrate that the effect of the ternary addition on processability and age hardenability of the Ni—Ru ternary or higher alloy was profound.

Binary Ni—Ru compositions were synthesized over a range of Ru concentrations. The binary alloys were designated as Alloys 2147 (28.8 wt % Ru), 2179 (34.6 wt % Ru), 2148 (40.1 wt % Ru), and 2293 (44.8 wt % Ru). Each sample was homogenized at 1,400° C. (except for Alloy 2293 which was homogenized at 1,500° C.) under a mildly reducing, $N_2$-3.5% $H_2$ atmosphere. Afterwards, some samples retained coarse, insoluble Ru particles. The compositions successfully underwent cold area reduction after the homogenization heat treatment, thus demonstrating that they could be processed. For the low-Ru binary composition CE-1 (10.0 wt % Ru), decomposition was not achieved even by extended 700° C. age hardening heat treatments.

The effect of the ternary or higher additions on processability and age hardenability of the Ni—Ru ternary or higher alloy base was profound. For platinum, the nickel-ruthenium-platinum alloys examined were found to be processable. Increasing additions of platinum apparently caused a retardation of the discontinuous precipitation reaction. An addition of 5.3 wt % Pt in a nickel-ruthenium matrix, Alloy 2180, underwent complete decomposition during a 700° C. age hardening step. In contrast, higher platinum concentrations, such as 15 wt % in Alloy 2182, suppressed the age hardening reaction so that approximately half of the alloy remained as undecomposed solid solution after the same age hardening heat treatment.

Rhenium has low solubility in nickel and high affinity for ruthenium. While they remained processable, addition of rhenium to Ni—Ru ternary or higher alloy in Alloys 2183 and 2184 resulted in copious, large, insoluble primary ruthenium-rich particles throughout the sample. These primary particles may be effective at reducing the volume fraction of the lamellar microstructure by reducing the proportion of ruthenium available to participate in the DP reaction and promoting decoupled DP. An additional composition, Alloy 2217, was synthesized with a higher ratio of nickel to ruthenium in an attempt to homogenize the nickel-ruthenium-rhenium alloy composition. Despite the relatively lower ruthenium concentration in Alloy 2217, copious ruthenium-rich particles remained after homogenization at 1,400° C.

Ternary alloying additions of tungsten (Alloy 2186), molybdenum (Alloy 2188), tantalum (Alloy 2191), and niobium (Alloy 2192) also efficiently hindered colony growth, and these samples did not fully decompose at 700° C. The impeded decomposition did not show any benefit in refining average lamellar wavelength. Low concentrations of niobium in Alloy 2225 were also found to degrade castability of the alloy, resulting in porosity that was an impediment to processing. It is believed that Ni—Ru ternary or higher alloys comprising at least one of tungsten, molybdenum, tantalum, and niobium may still be viable with different melting and casting practices and different alloy compositions.

Adding palladium to the nickel-ruthenium matrix in Alloy 2189 was found to induce non-equilibrium melting in the alloy during 1,400° C. homogenization heat treatments. Significant grain boundary decorations with palladium-nickel pseudo-eutectic phases and copious pores likely resulted from grain boundary liquation. It is currently believed that nickel-ruthenium-palladium alloys may still be viable with different homogenization heat treatment practices and different alloy compositions.

The rhodium addition in Alloy 2190 enabled rapid colony growth during discontinuous precipitation. This composition completely decomposed at 700° C.; fine lamellar regions were separated by coarse lamellae and equiaxed particles. Rhodium solute seemed to do little to change average lamellar wavelengths.

Gold was found to be an efficient lamellar refiner; it increased the reaction front velocity and created heterogeneous nucleation sites within alloy grains. A range of nickel: ruthenium:gold ratios were synthesized, and all were found to be processable. Compositions with lower nickel concentrations tended to have higher volume fractions of retained ruthenium-rich and gold-rich microconstituents. In some of the more heavily gold- and ruthenium-saturated alloys, their respective phases that could not be dissolved with the 1,400° C. homogenization practice, but the synthesized samples remained processable. Gold was observed to coerce a fine lamellar structure upon age hardening at 700° C. It is not clear why gold drives the rapid decomposition; it could be due to ruthenium's and gold's high solubility in nickel and mutual immiscibility, the spinodal decomposition tendency of nickel and gold, the creation of additional heterogeneous nucleation site, and/or enhancement of interfacial diffusion rates. The only exception to age hardenability was Alloy 2288, in which the high gold content, 20.3 wt %, resulted in gold-rich grain boundary decoration that apparently impeded DP. Alloy 2288 instead evolved a Widmanstatten morphology after extended age hardening.

Cobalt and iridium have high solubility in both nickel and ruthenium. Low cobalt (Alloy 2187), high cobalt (Alloy 2218), and iridium (Alloy 2219) alloying additions in the nickel-ruthenium matrix resulted in an alloy that homogenized into a single-phase solid solution without ejecting ruthenium or forming precipitates. The alloys were processable. Aged microstructures for both compositions were comparable to binary nickel-ruthenium binary Alloy 2148. Alloy 2218 was observed to form a thick, blue oxide layer when heat-treated in open atmosphere, and was magnetic after age hardening.

Upon the addition of chromium to the nickel-ruthenium matrix to synthesize Alloy 2220, ruthenium-rich areas of dendrites in the as-cast microstructure were observed to coarsen into a mesoscale two-phase microstructure. Chromium distribution, as determined via energy dispersive X-ray spectroscopy, showed a nearly even partitioning between the nickel-rich (suspected to be face-centered cubic) and ruthenium-rich (suspected to be hexagonal close-packed) phases. Aging at 700° C. produced only partial decomposition. It is currently believed that different homogenization treatments and alloy composition may result in a refined two-phase structure, which would result in finer microstructures and increased population of heterogeneous nucleation sites for DP.

Alloy 2221 included the addition of vanadium. Some melting was observed after 1,400° C. homogenization indicative of non-equilibrium melting. The alloy containing 7.4 wt % of vanadium remained processable, and a normal DP age hardening reaction was observed.

Copper additions to the nickel-ruthenium matrix also caused ruthenium rejection from the nickel matrix, which subsequently coalesced into coarse particles when Alloy 2223 was homogenized, but the composition remained processable. Copper solute was observed to refine the lamellar structure after the age hardening heat treatment.

The addition of zirconium in a nickel-ruthenium matrix resulted in significant melting after 1,400° C. homogenization. Zirconium-rich precipitates formed in both nickel matrix and ruthenium particles after re-solidification. As a result, Alloy 2222 was not processable. The nickel-ruthenium matrix with an alloying addition of titanium—Alloy 2224—was observed to be unprocessable. A low melting temperature eutectic microconstituent emerged during 1,400° C. homogenization, and titanium caused significant oxidation on the outside of the experimental sample. Alloy 2226, containing 12.9 wt % of iron, was found to lower the liquidus temperature of the Ni matrix to below 1,400° C. Homogenization of the complete ingot could not be completed, nor could the aged hardness be assessed, and so the composition comprising iron was not processable. It is noted that the nickel-ruthenium ternary or higher alloys disclosed herein may include at least one of titanium, zirconium, or iron, for example, when the nickel-ruthenium ternary or higher alloys include certain ternary or higher additions and/or exhibit certain compositions.

Figure 8A:
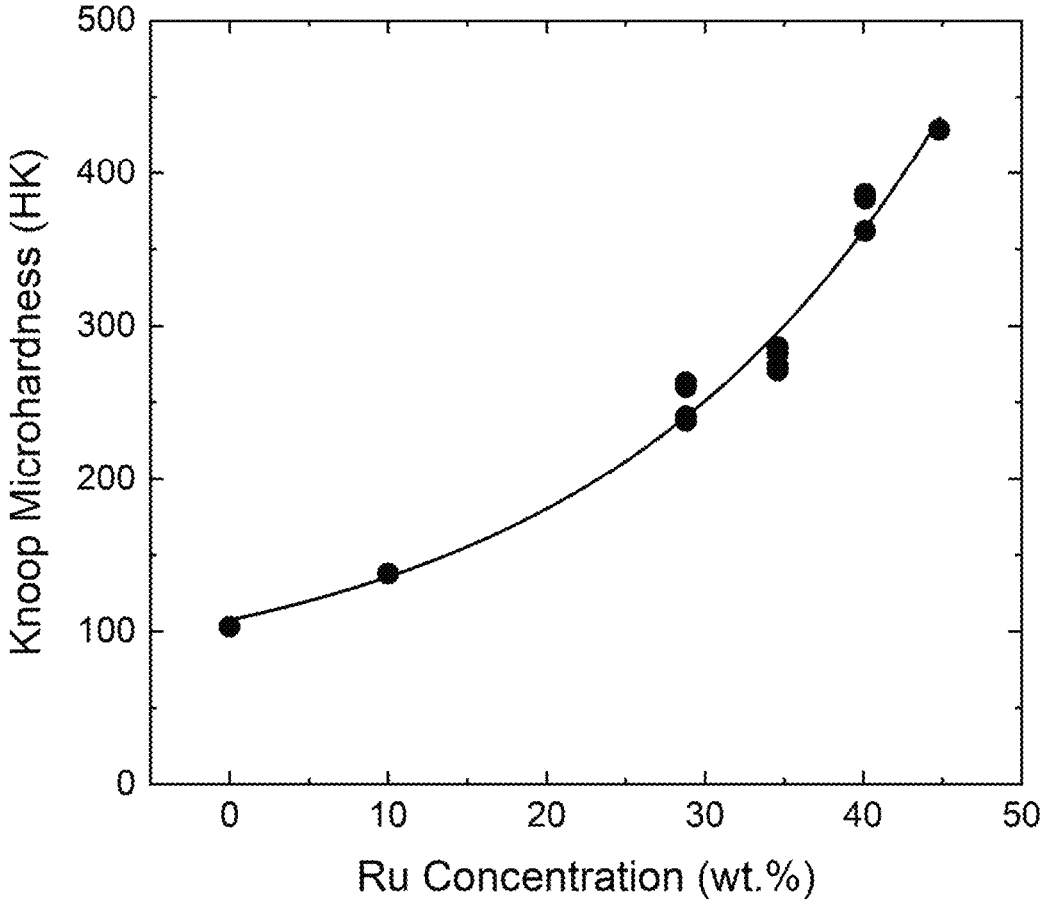
FIG. 8A is a graph illustrating the hardness of various Ni—Ru binary alloys to determine the effect of ruthenium on the homogenized nickel-rick matrix.
Figure 8B:
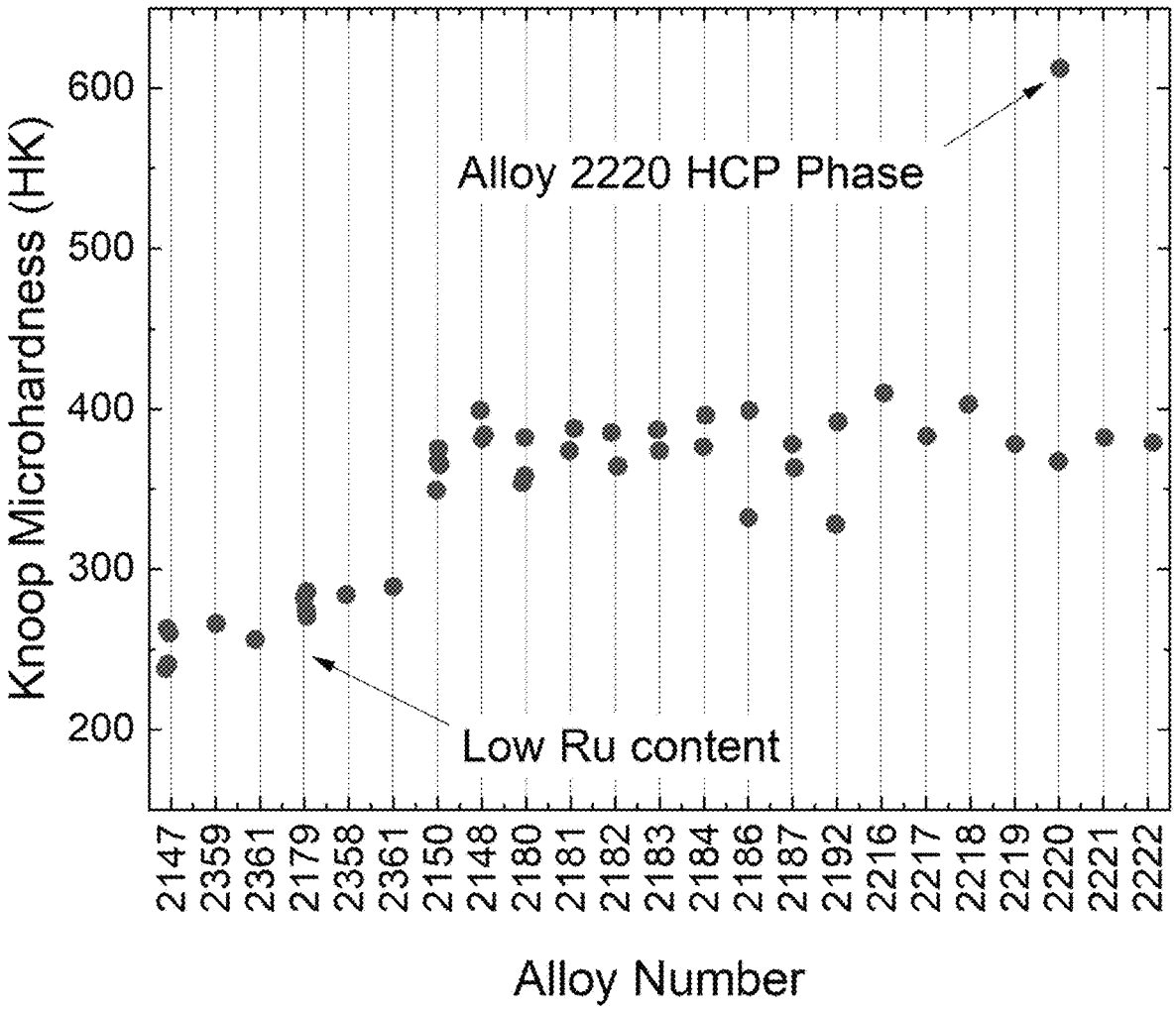
FIG. 8B is a graph illustrating the hardness of each of the Ni—Ru alloys after the homogenization treatment.

As previously discussed, the hardness of the Ni—Ru ternary or higher alloys were measured after the homogenization treatment. The hardness of the various alloys after the homogenization treatment are shown in Table 2. FIG. 8A is a graph illustrating the hardness of various Ni—Ru binary alloys to determine the effect of ruthenium on the homogenized nickel-rich matrix. As shown in FIG. 8A, the Ni—Ru binary alloys were significantly harder than pure, unstrained nickel, which has a hardness of about 100 HK, and demonstrates solid solution strengthening is proportional to the level of ruthenium in the Ni—Ru binary alloy. FIG. 8B is a graph illustrating the hardness of various Ni—Ru binary alloys as well as each of the Ni—Ru ternary or higher alloys of the present disclosure after the homogenization treatment. Homogenized hardnesses were unexpectedly unchanged from the binary Ni—Ru Alloy 2148, even for those with large ternary solute concentrations. Alloy 2220 (Ni—Ru—Cr) exhibited regions of high hardness, about HK 610, which corresponded to retained Ru-rich, suspected hexagonal close packed phase.

The working examples demonstrated that at least some of the Ni—Ru ternary or higher alloys exhibited DP reactions during the age hardening process. For example, FIGS. 9A-9D are images taken from Alloy 2236 (Ni—Ru—Au) (FIG. 9A), Alloy 2148 (Ni—Ru) (FIG. 9B), Alloy 2179 (Ni—Ru) (FIG. 9C), and Alloy 2147 (Ni—Ru) (FIG. 9D), respectively, showing the various wavelength in the discontinuously precipitated microconstituents thereof. It is noted that FIGS. 9A-9D are arranged from the finest average lamellar wavelengths (FIG. 9A) to the coarsest average lamellar wavelengths (FIG. 9D). It is noted that the images of FIGS. 9A-9D, Alloy 2236 and Alloy 2148 were decomposed at 700° C., Alloy 2179 was decomposed at 850° C., and Alloy 2147 was decomposed at 1000° C.

Figure 10:
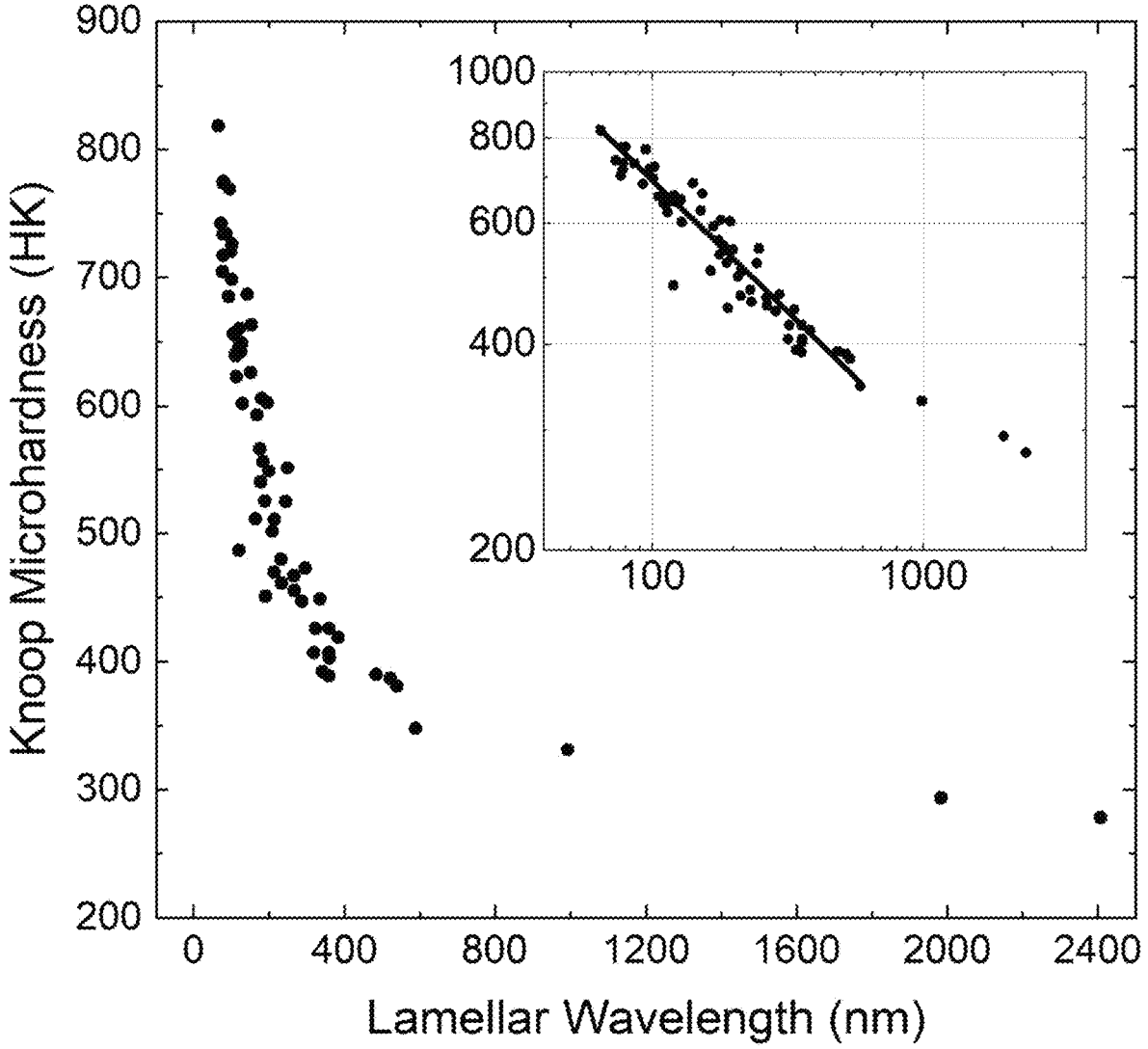
FIG. 10 is a graph illustrating the relationship between the measured hardness of the Ni—Ru alloys after age hardening and the measured average lamellar wavelength taken from Table 2.

FIG. 10 is a graph illustrating the relationship between the measured hardness of various Ni—Ru binary or higher alloys after age hardening and the measured average lamellar wavelength taken from Table 2 (FIGS. 7A and 7B). FIG.

10 demonstrates the dependence of the hardness upon the average lamellar wavelength. It is believed that very finest microstructural features push the age-hardened properties to extreme hardnesses in excess of 500 HK. When examined in log-log presentation, this relationship becomes linear, suggesting a power law relationship—similar to Hall-Petch—exists between hardness and average lamellar wavelength. Thus, additional optimization that refines the average lamellar wavelength will be expected to increase the alloy hardness.

As previously discussed, it has also been found that aging the Ni—Ru ternary or higher alloy below the nickel-ruthenium solvus temperature does not guarantee decomposition per se. For instance, Alloy 2179 was aged at 1150° C. for an extended period, after which very few DP nuclei were observed. The hindered transformation is most likely due to difficult heterogeneous nucleation at high temperatures. It is also possible to achieve complete decomposition below 700° C., as demonstrated by Alloys 2236 and 2293. The high Au and Ru additions, respectively, results in faster reaction front propagation at low temperatures and can finely decompose at 600° C.

Figure 11:
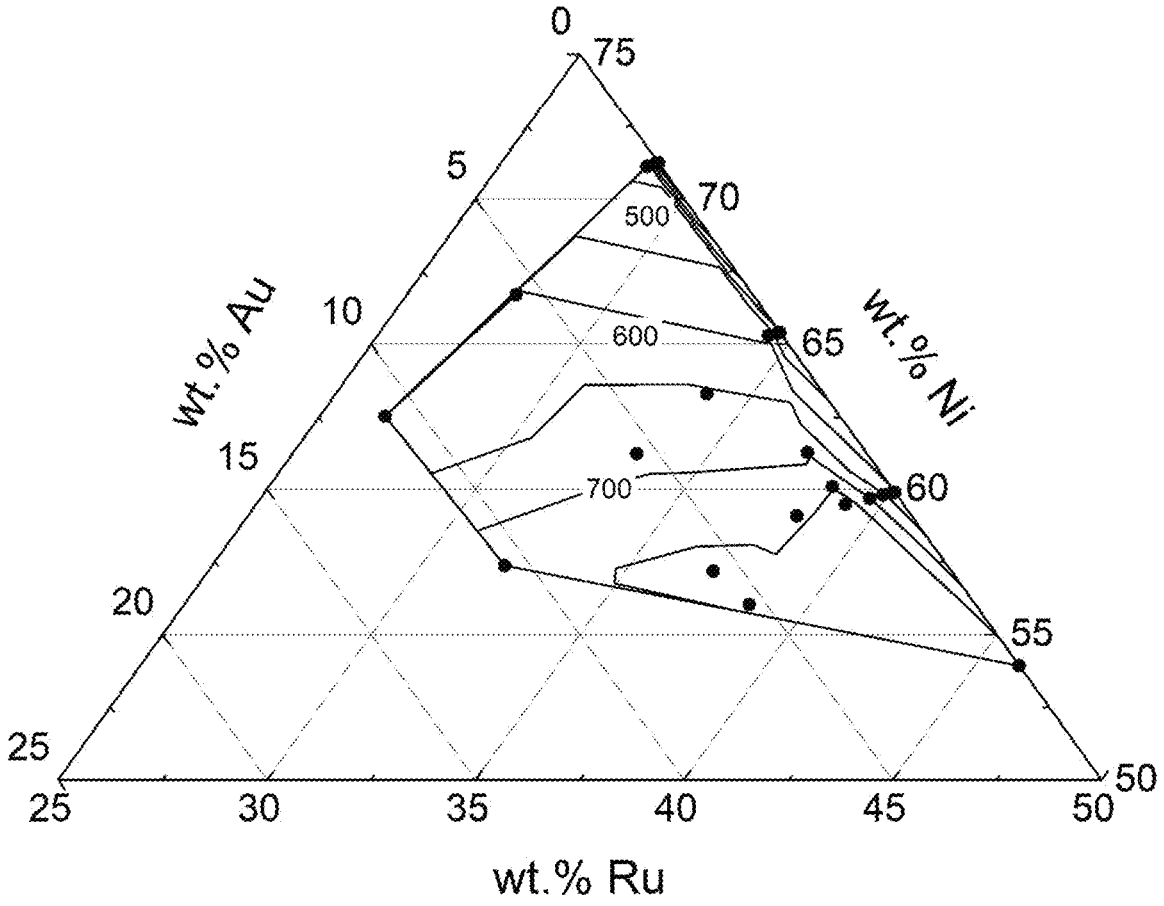
FIG. 11 is a ternary phase diagram illustrating the hardness of the nickel-ruthenium alloy in Knoop hardness.

FIG. 11 is a ternary phase diagram illustrating the hardness of the Ni—Ru—Au alloy in HK. Visualization of age hardening results in the nickel-ruthenium-gold ternary alloy space indicates that increasing ruthenium and gold concentrations has an unexpected synergistic effect to increase the age-hardened hardness. FIG. 11 illustrates this synergistic effect because the hardness lines are bunched together near 0 wt % gold axis thereby indicating that slight increases in the gold content of the Ni—Ru alloy significantly increases the age hardened microhardness of the alloy.

FIG. 12 is a graph illustrating the effect of gold ternary addition to the nickel-ruthenium matrix after age hardening. FIG. 12 also indicates that increasing ruthenium and gold concentrations has an unexpected synergistic effect to increase the age-hardened hardness. For example, with regards to the alloys based on alloys 2147 and 2179, FIG. 12 demonstrates that increasing the amount of gold in the Ni—Ru alloy from 0 wt % (i.e., not present) to 0.08 wt % increases the age hardened microhardness of the Ni—Ru alloy by about 10% and increasing the amount of gold in the Ni—Ru alloy from 0.08 wt % to 0.3 wt % also has a significant effect on the age hardened microhardness of the Ni—Ru ternary alloy. Similarly, with regards to the alloy based on alloy 2148, FIG. 12 demonstrates that increasing the amount of gold in the Ni—Ru alloy from 0 wt % to 0.1 wt % and from 0.1 wt % to 0.3 wt % significant increases the age hardened microhardness of the Ni—Ru ternary alloy. The significant effect that gold has on the age hardened microhardness of the Ni—Ru ternary alloys at such low concentrations was unexpected. It has been found that copper has a similar effect on the age hardened microhardness of the Ni—Ru ternary or higher alloys disclosed herein. It is noted that the other ternary or higher additions disclosed herein may have similar effect on the microhardness of the Ni—Ru ternary or higher alloys as gold or other significant effects on the properties of the Ni—Ru ternary or higher alloys, even at low concentrations.

The trendlines added to FIG. 12 (estimating the relationship between age hardened microhardness and gold concentrations for each alloy) become flat above a threshold value, which indicate that increasing the concentration of gold in the Ni—Ru ternary alloys has minimal effect on the microhardness of the Ni matrix above a threshold value (e.g., about 4 wt %). While not desiring to be bound by a particular theory, it is believed that trendlines are flat due to additional gold moving the bulk alloy composition into two-phase and three-phase regions. Additional gold is not entrained in the Ni matrix and forms a distinct Au—Ni phase; depending on the composition a Ru—Ni phase will also be stable with the Au—Ni phase and Ni matrix. The compositions of the constituent phases are constant, with bulk composition altering phase fractions. Further, while not desiring to be bound by a particular theory, it is believed that addition of gold will no longer affect lamellar length scales and microhardness of the Ni matrix, but may still have significant effect on the overall hardness and electrical conductivity of the Ni—Ru ternary of higher concentrations even when the gold concentrations are increased above the threshold values by at least one of modifying the manufacturing process used to form the Ni—Ru ternary or higher additions, changing the ruthenium concentration in the Ni—Ru ternary or higher alloys, or including additional ternary or higher additions in the Ni—Ru ternary or higher alloys.

Among the Ni—Ru—Au compositions, Alloys 2236 and 2246 possessed an unexpectedly high hardness. Alloy 2236 has less Au and higher concentrations of Ru, which produce a higher hardness material. This material surpasses the requirements for pogo pin applications. Alloy 2246 reaches the nominal hardness goal and has less Ru. This may make the alloy more conducive to wrought processing, and opens the possibility of using lower temperatures for homogenization.

It is also possible to achieve complete decomposition below 700° C., as demonstrated by Alloys 2236. The high Au results in faster reaction front propagation at low temperatures and can finely decompose at 600° C.

While various aspects and embodiments have been disclosed herein, other aspects and embodiments are contemplated. The various aspects and embodiments disclosed herein are for purposes of illustration and are not intended to be limiting.

Terms of degree (e.g., "about," "substantially," "generally," etc.) indicate structurally or functionally insignificant variations. In an example, when the term of degree includes a term indicating quantity, the term of degree is interpreted to mean±10%, ±5%, or +2% of the term indicating quantity. In an example, when the term of degree is used to modify a shape, the term of degree indicates that the shape being modified by the term of degree has the appearance of the disclosed shape. For instance, the term of degree may be used to indicate that the shape may have rounded corners instead of sharp corners, curved edges instead of straight edges, one or more protrusions extending therefrom, is oblong, is the same as the disclosed shape, etc.

What is claimed is:

1. A nickel and ruthenium-based alloy, comprising:
nickel at about 54 to about 71 wt % of the alloy;
ruthenium at about 17 to about 45 wt % of the alloy; and
at least one ternary or higher addition at greater than zero to about 20 wt % of the alloy, the at least one ternary or higher addition comprising gold, cobalt, chromium, copper, iridium, molybdenum, niobium, palladium, platinum, rhenium, rhodium, tantalum, vanadium, tungsten, or any combination thereof,
wherein the alloy is age hardened and exhibits a Knoop microhardness of about 500 or more.

2. The alloy of claim 1, wherein nickel is present at about 54 to about 60 wt % of the alloy.

3. The alloy of claim 1, wherein ruthenium is present at about 27 to about 45 wt % of the alloy.

4. The alloy of claim 1, wherein ruthenium is present at about 25 to about 40 wt % of the alloy.

5. The alloy of claim 1, wherein the at least one ternary or higher addition is present at about 0.1 to about 6 wt % of the alloy.

6. The alloy of claim 1, wherein the at least one ternary or higher addition is present at about 0.7 to about 11 wt % of the alloy.

7. The alloy of claim 1, wherein the at least one ternary or higher addition are present at about 1.4 to about 15 wt % of the alloy.

8. The alloy of claim 1, wherein the at least one ternary or higher addition comprises gold.

9. The alloy of claim 1, wherein the alloy exhibits a Knoop microhardness of about 600 or more.

10. The alloy of claim 1, wherein the alloy exhibits an average lamellar wavelength of about 150 nm or less.

11. A test probe or test probe component comprising the nickel-ruthenium-based alloy of claim 1.

12. The test probe or test probe component of claim 11, wherein the probe is configured as a cobra probe, a cantilever probe, a pogo pin probe, a LED probe, a vertical probe, or a MEMS probe.

13. A probe card comprising the test probe or test probe component according to claim 11.

14. A method of producing a nickel-ruthenium-based alloy, the method comprising:

forming the alloy, the alloy comprising:

nickel at about 54 to about 71 wt % of the alloy;

ruthenium at about 17 to about 45 wt % of the alloy;

at least one ternary or higher addition at greater than zero to about 20 wt % of the alloy, the at least one ternary or higher addition comprising gold, cobalt, chromium, copper, iridium, molybdenum, niobium, palladium, platinum, rhenium, rhodium, tantalum, vanadium, tungsten, or any combination thereof, wherein the alloy is age hardened and exhibits a Knoop microhardness of 500 or more.

15. The method of claim 14, further comprising homogenizing the alloy after forming the alloy.

16. The method of claim 14, further comprising age hardening the alloy at a temperature between about 600 and about 1,300° C.

17. The method of claim 16, further comprising shaping the alloy into a desired shape before age hardening the alloy.

18. The method of claim 14, further comprising age hardening the alloy at a temperature between about 700 and about 850° C.

* * * * *